US010496014B2

(12) United States Patent
Inagaki et al.

(10) Patent No.: US 10,496,014 B2
(45) Date of Patent: Dec. 3, 2019

(54) ELECTROPHOTOGRAPHIC IMAGE FORMING DEVICE

(71) Applicant: Konica Minolta Inc., Tokyo (JP)

(72) Inventors: Keiichi Inagaki, Hino (JP); Daisuke Kodama, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/162,991

(22) Filed: Oct. 17, 2018

(65) Prior Publication Data

US 2019/0163093 A1 May 30, 2019

(30) Foreign Application Priority Data

Nov. 27, 2017 (JP) ..... 2017-226976

(51) Int. Cl.

| | |
|---|---|
| ***G03G 15/09*** | (2006.01) |
| ***G03G 5/147*** | (2006.01) |
| ***G03G 5/05*** | (2006.01) |
| ***G03G 5/047*** | (2006.01) |
| ***G03G 9/08*** | (2006.01) |
| ***G03G 21/10*** | (2006.01) |
| ***G03G 5/06*** | (2006.01) |

(52) U.S. Cl.

CPC ..... *G03G 15/09* (2013.01); *G03G 5/047* (2013.01); *G03G 5/0507* (2013.01); *G03G 5/0592* (2013.01); *G03G 5/0614* (2013.01); *G03G 5/14704* (2013.01); *G03G 5/14708* (2013.01); *G03G 5/14791* (2013.01); *G03G 9/08* (2013.01); *G03G 21/10* (2013.01)

(58) Field of Classification Search

CPC ..... G03G 15/09; G03G 5/047; G03G 9/08; G03G 21/10

See application file for complete search history.

(56) References Cited

U.S. PATENT DOCUMENTS

2014/0010572 A1* 1/2014 Karasawa ..... G03G 21/00 399/111
2016/0291525 A1* 10/2016 Fujita ..... G03G 15/751
2017/0082970 A1* 3/2017 Inagaki ..... G03G 21/0094

FOREIGN PATENT DOCUMENTS

JP 2005208325 A 8/2005

* cited by examiner

*Primary Examiner* — Thorl Chea
(74) *Attorney, Agent, or Firm* — Lucas & Mercanti, LLP

(57) ABSTRACT

A tandem type electrophotographic image forming device using an organic photoreceptor, includes a plurality of image forming units each including at least: an electrostatic latent image former; a developer; a lubricant supplier; and a cleaner, wherein at least one combination composed of the two adjacent image forming units including toners having different colors satisfies the following formula (1) if a universal hardness of an organic photoreceptor A included in the image forming unit disposed on an upstream side is represented by Ha, and a universal hardness of an organic photoreceptor B included in the image forming unit disposed on a downstream side is represented by Hb.

[Numerical formula 1]

$$Hb-Ha \geq 10\ \mathrm{N/mm^2} \quad (1)$$

12 Claims, 4 Drawing Sheets

ELECTROPHOTOGRAPHIC IMAGE FORMING DEVICE

The entire disclosure of Japanese patent Application No. 2017-226976, filed on Nov. 27, 2017, is incorporated herein by reference in its entirety.

BACKGROUND

Technological Field

The present invention relates to an electrophotographic image forming device.

Description of the Related Art

In an electrophotographic image forming device, an electrophotographic photoreceptor (hereinafter, also referred to simply as "photoreceptor") is used in order to form an electrostatic latent image corresponding to an image to be formed. A surface of the photoreceptor is charged by a charging member of the image forming device. The electrostatic latent image is formed by irradiating the charged surface of the photoreceptor with light. When a toner is supplied to the photoreceptor on which the electrostatic latent image is formed, a toner image is formed. The toner image is transferred onto a recording medium. A toner remaining on the surface of the photoreceptor after the transfer is removed by a cleaning member of the image forming device. As the photoreceptor, an organic photoreceptor including a conductive support, an organic photosensitive layer disposed on the conductive support, and a protective layer disposed on the organic photosensitive layer is known.

A cured surface layer is excellent in abrasion resistance and scratch resistance, therefore functions as a protective layer, and can reduce the amount of depletion of a surface of an organic photoreceptor due to a cleaning blade at the time of cleaning the organic photoreceptor. Therefore, the cured surface layer contributes to prolongation of the lifetime of the organic photoreceptor. However, this may easily cause cleaning failure, and may increase the frequency of occurrence of an image flow in a formed image. Even a protective layer excellent in abrasion resistance and scratch resistance may generate scratches, may deform a cleaning blade, and may increase the frequency of occurrence of slipping of a toner.

Here, it has been tried to solve the above problem from a viewpoint of further reducing the amount of depletion on a surface of the organic photoreceptor, and optimization of physical properties of the protective layer has been studied. For example, JP 2005-208325 A discloses an image forming device in which an image carrier has a surface layer containing a curable resin, the image carrier has a universal hardness and an elastic deformation ratio within a predetermined range, the image forming device includes a plurality of developers including developing agents of different colors, at least one of the plurality of developers includes abrasive grains in a developing agent, and the image forming device includes a rubbing member that rubs the image carrier and a cleaning blade as a cleaner that cleans the image carrier after transfer. Here, the abrasive grains have an effect of improving a cleaning property. JP 2005-208325 A discloses that in such an image forming device, mechanical deterioration of a surface layer of a photoreceptor hardly occurs by controlling the universal hardness and the elastic deformation ratio within a predetermined range, and that such a technique can contribute to preventing accumulation of a discharge product and the like, and particularly to preventing an image flow under a high humidity environment.

However, even in a case of optimizing the physical properties of a protective layer as in the technique of JP 2005-208325 A, in a tandem type electrophotographic image forming device, cleaning failure in an organic photoreceptor disposed on an upstream side cannot be sufficiently suppressed, and an image flow in a formed image cannot be sufficiently suppressed in some cases. In addition, the amount of depletion of a surface of an organic photoreceptor disposed on a downstream side is not sufficiently reduced, the lifetime of the organic photoreceptor is shortened, and slipping of a toner easily occurs in some cases. As described above, in the tandem type electrophotographic image forming device, it is still impossible to realize prolongation of the lifetime, slipping of a toner easily occurs, and the frequency of occurrence of an image flow in a formed image is high disadvantageously in a plurality of organic photoreceptors.

SUMMARY

Therefore, an object of the present invention is to provide, in a tandem type electrophotographic image forming device, a means capable of suppressing an image flow of a formed image, suppressing slipping of a toner, and realizing prolongation of the lifetime of an organic photoreceptor, eventually prolongation of the lifetime of the device itself.

To achieve the abovementioned object, according to an aspect of the present invention, there is provided a tandem type electrophotographic image forming device using an organic photoreceptor obtained by sequentially laminating at least a charge generating layer and a charge transporting layer on a conductive support, and the electrophotographic image forming device reflecting one aspect of the present invention comprises a plurality of image forming units each including at least: an electrostatic latent image former that forms an electrostatic latent image on the organic photoreceptor; a developer that supplies a toner to the organic photoreceptor and develops the electrostatic latent image to form a toner image; a lubricant supplier that supplies a lubricant to a surface of the organic photoreceptor; and a cleaner that removes a toner remaining on the surface of the organic photoreceptor with a cleaning blade, wherein at least one combination composed of the two adjacent image forming units including toners having different colors satisfies the following formula (1) if a universal hardness of an organic photoreceptor A included in the image forming unit disposed on an upstream side is represented by Ha, and a universal hardness of an organic photoreceptor B included in the image forming unit disposed on a downstream side is represented by Hb.

[Numerical formula 1]

$$Hb-Ha \geq 10\ \mathrm{N/mm^2} \quad (1)$$

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
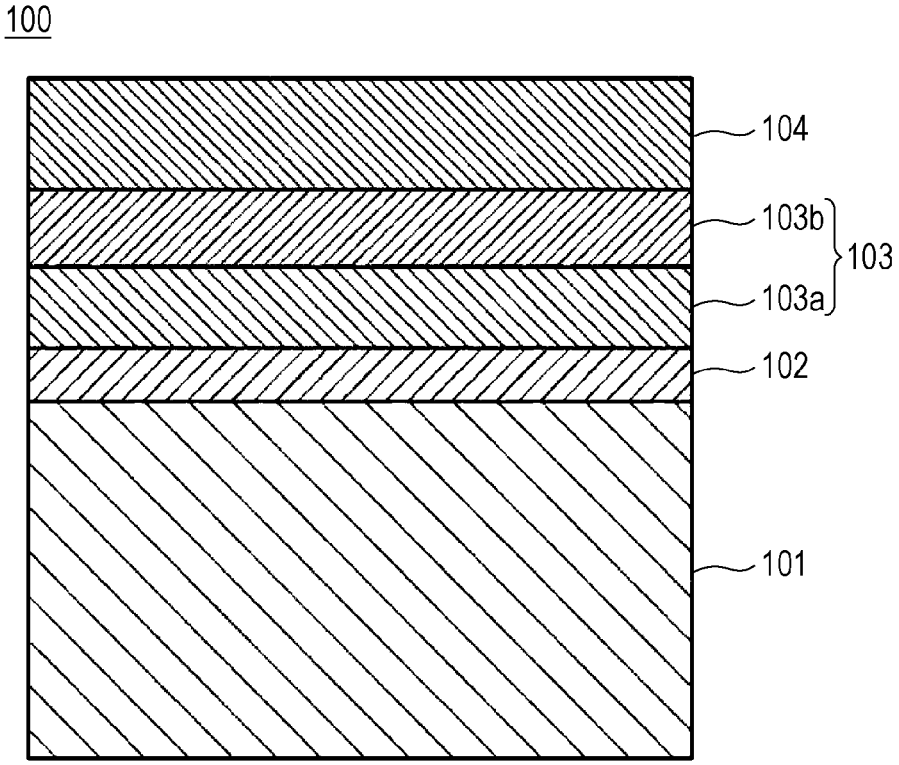
FIG. 1 is a schematic cross-sectional view illustrating a structure of an organic photoreceptor in a tandem type electrophotographic image forming device according to an embodiment of the present invention.

Hereinafter, one or more embodiments of the present invention will be described with reference to the drawings. However, the scope of the invention is not limited to the disclosed embodiments.

Hereinafter, a preferable embodiment of the present invention will be described. Here, "X to Y" indicating a range means "X or more and Y or less". In addition, unless otherwise specified, operation, measurement of physical properties, and the like are performed under conditions of room temperature (20 to 25° C.)/relative humidity of 40 to 50% RH. Here, "(meth)acryl" refers to methacryl and/or acryl.

Incidentally, in the description of the drawings, the same components are denoted by the same reference numerals, and duplicate descriptions are omitted. A dimensional ratio in the drawings is exaggerated for convenience of explanation and may differ from the actual ratio.

The embodiment of the present invention relates to a tandem type electrophotographic image forming device using an organic photoreceptor obtained by sequentially laminating at least a charge generating layer and a charge transporting layer on a conductive support, including a plurality of image forming units each including at least: an electrostatic latent image former that forms an electrostatic latent image on the organic photoreceptor; a developer that supplies a toner to the organic photoreceptor and develops the electrostatic latent image to form a toner image; a lubricant supplier that supplies a lubricant to a surface of the organic photoreceptor; and a cleaner that removes a toner remaining on the surface of the organic photoreceptor with a cleaning blade, in which at least one combination composed of two adjacent image forming units including toners having different colors satisfies the following formula (1) if the universal hardness of an organic photoreceptor A included in the image forming unit disposed on an upstream side is represented by Ha, and the universal hardness of an organic photoreceptor B included in the image forming unit disposed on a downstream side is represented by Hb.

[Numerical formula 2]

$$Hb-Ha \geq 10\ \mathrm{N/mm^2} \quad (1)$$

The present inventors estimate a mechanism with which the above-described configuration solves a problem as follows.

A surface of an organic photoreceptor having a protective layer is hardly depleted. Therefore, it is difficult to scrape off and remove foreign matters including a residual toner firmly attached to the surface by a cleaning blade together with a very thin region on the surface of the organic photoreceptor. Therefore, a sliding property of the surface of the organic photoreceptor is lowered, friction between the surface of the organic photoreceptor and the cleaning blade increases, and a blade torque increases. Particularly, in a tandem type electrophotographic image forming device, a toner which has been transferred from an organic photoreceptor disposed on an upstream side to an intermediate transfer belt is transferred to a non-image part of the organic photoreceptor disposed on a downstream side. That is, reverse transfer occurs. As a result, as an organic photoreceptor is disposed on a further downstream side, the amount of a reverse-transferred toner (reverse transfer toner) is larger, and the amount of a toner reaching a cleaning blade that cleans the organic photoreceptor is also larger. Such a cleaning blade that cleans an organic photoreceptor disposed on a downstream side has a lower sliding property with respect to a surface of the organic photoreceptor and further increases friction between the surface of the organic photoreceptor and the cleaning blade.

Examples of a means that suppresses an increase in friction between the surface of the organic photoreceptor and the cleaning blade in consideration of such characteristics of the protective layer include supply of a lubricant to the surface of the organic photoreceptor. However, in an organic photoreceptor disposed on a downstream side of a tandem type electrophotographic image forming device, friction between a surface of the organic photoreceptor and a cleaning blade is extremely large as described above. Therefore, even if a lubricant is supplied to the surface of the organic photoreceptor, most of the lubricant present on the surface of the organic photoreceptor is scraped off by the cleaning blade and removed. Therefore, the amount of the lubricant on the organic photoreceptor disposed on a downstream side is relatively smaller than the amount of the lubricant on an organic photoreceptor disposed on an upstream side. At this time, similarly to a case of not using a lubricant, the organic photoreceptor disposed on a downstream side generates scratches on a protective layer to shorten the lifetime of the organic photoreceptor and to easily cause slipping of a toner.

Here, examples of a means that suppresses generation of scratches on a surface of an organic photoreceptor include increasing the surface hardness of the organic photoreceptor. However, in a tandem type electrophotographic image forming device, in a case where the surface hardness of a plurality of organic photoreceptors is uniformly increased, an organic photoreceptor disposed on an upstream side where the amount of a lubricant present on a surface of an organic photoreceptor is large makes friction between the surface of the organic photoreceptor and the cleaning blade excessively small. As a result, the amount of depletion of the organic photoreceptor is excessively small. For this reason, an organic photoreceptor disposed on an upstream side easily causes cleaning failure, and increases the frequency of occurrence of an image flow of a formed image.

Meanwhile, in the tandem type electrophotographic image forming device according to the embodiment of the present invention, by setting the universal hardness which is the surface hardness of an organic photoreceptor disposed on a downstream side to a value higher than the universal hardness of an organic photoreceptor disposed on an upstream side, generation of scratches is suppressed even in an organic photoreceptor which is disposed on the downstream side and likely to lack a lubricant. In addition, by setting the universal hardness which is the surface hardness of each organic photoreceptor as a predetermined relationship depending on the position of each organic photoreceptor among the plurality of organic photoreceptors, the extent to which a reverse transfer toner is scraped off and removed by a cleaning blade together with a very thin region of a surface of each organic photoreceptor changes. Furthermore, the amount of the reverse transfer toner present on a surface of each organic photoreceptor changes, and a sliding property of the surface of each organic photoreceptor and friction between the surface of each organic photoreceptor and the cleaning blade change. As a result, the amount of a lubricant scraped off by the cleaning blade on the surface of each organic photoreceptor changes. As a result, the amount of a lubricant on the surface of each organic photoreceptor is an optimum value corresponding to the universal hardness of each organic photoreceptor. As a result, an organic photoreceptor disposed on an upstream side achieves a necessary and sufficient amount of depletion by the cleaning blade. Therefore, a favorable cleaning property is obtained, and the frequency of occurrence of an image flow of a formed image is lowered. In addition, an organic photoreceptor disposed on a downstream side suppresses an increase in friction between a surface of the organic photoreceptor and the cleaning blade, and suppresses generation of scratches in a protective layer. This makes it possible to prolong the lifetime of an organic photoreceptor and suppresses occurrence of slipping of a toner.

As described above, the present invention optimizes a relationship among the amount of a reverse transfer toner which varies depending on the position of each organic photoreceptor in a tandem type electrophotographic image forming device, the amount of a lubricant which can be present on each organic photoreceptor and varies depending on the position of each organic photoreceptor in the tandem type electrophotographic image forming device, and a universal hardness which is the surface hardness of each organic photoreceptor. As a result, the tandem type electrophotographic image forming device according to the embodiment of the present invention suppresses an image flow of a formed image, suppresses slipping of a toner, and realizes prolongation of the lifetime of an organic photoreceptor, eventually prolongation of the lifetime of the device itself in an organic photoreceptor included in each of the plurality of image forming units.

Note that the above mechanism is based on estimation, and correctness or fault of the mechanism does not affect a technical scope of the present invention.

<Organic Photoreceptor>

An organic photoreceptor means an electrophotographic photoreceptor in which an organic compound has at least one of a charge generating function and a charge transporting function indispensable for constituting the electrophotographic photoreceptor, and includes a known organic photoreceptor such as a photoreceptor constituted by a known organic charge generating material or organic charge transporting material or a photoreceptor in which a polymer complex has a charge generating function and a charge transporting function.

In the tandem type electrophotographic image forming device according to the embodiment of the present invention, a universal hardness (HU) measured from an outermost surface layer side (for example, a charge transporting layer or protective layer side) of each of the organic photoreceptors is not particularly limited, but is preferably within a range of 180 $N/mm^2$ to 320 $N/mm^2$, more preferably within a range of 180 $N/mm^2$ to 300 $N/mm^2$, and still more preferably within a range of 220 to 280 $N/mm^2$. Within the above range, it is more difficult to generate scratches with respect to a rubbing force of a cleaning blade, and it is possible to refresh a surface more appropriately.

The universal hardness can be measured using a commercially available hardness measuring device and can be measured using an ultramicro hardness tester "H-100V" (manufactured by Fischer Instruments K. K.). Note that methods for measuring and calculating the universal hardness are described in detail in Examples.

The universal hardness measured from an outermost surface layer side of an organic photoreceptor can be controlled particularly by disposing a protective layer as the outermost layer, or by adjusting the kind and content of a material constituting the outermost surface layer and conditions thereof and the like in a case where a polymerization reaction is performed.

[Configuration of Organic Photoreceptor]

Hereinafter, the electrophotographic image forming device according to the embodiment of the present invention will be described with reference to the attached drawings. However, the present invention is not limited only to the embodiment described below.

FIG. 1 is a schematic cross-sectional view illustrating a structure of an organic photoreceptor in the tandem type electrophotographic image forming device according to the embodiment of the present invention.

In the electrophotographic image forming device according to the embodiment of the present invention, an organic photoreceptor 100 has a structure obtained by sequentially laminating at least a charge generating layer 103*a* and a charge transporting layer 103*b* on a conductive support 101. Here, in a case where the organic photoreceptor 100 has a laminated structure obtained by directly laminating the charge generating layer 103*a* and the charge transporting layer 103*b*, the laminated structure portion is also referred to as an organic photosensitive layer 103.

In the electrophotographic image forming device according to the embodiment of the present invention, in at least one combination composed of two adjacent image forming units including toners having different colors, at least one of an organic photoreceptor A included in an image forming unit disposed on an upstream side and an organic photoreceptor B included in an image forming unit disposed on a downstream side preferably has a protective layer as an outermost surface layer, and each of the organic photoreceptors A and B more preferably has a protective layer as an outermost surface layer. At this time, as illustrated in FIG. 1, the organic photoreceptor 100 having a protective layer is formed by sequentially laminating at least the charge generating layer 103*a*, the charge transporting layer 103*b*, and a protective layer 104 on the conductive support 101, and the protective layer 104 is an outermost surface layer. Among these structures, in at least two combinations each composed of two adjacent image forming units including toners having different colors, at least one of the organic photoreceptors A and B preferably has a protective layer as an outermost surface layer, and each of the organic photoreceptors A and B more preferably has a protective layer as an outermost surface layer. In addition, in at least three combinations each composed of two adjacent image forming units including toners having different colors, at least one of the organic photoreceptors A and B preferably has a protective layer as an outermost surface layer, and each of the organic photoreceptors A and B more preferably has a protective layer as an outermost surface layer. Each of organic photoreceptors included in all the image forming units particularly preferably has a protective layer as an outermost surface layer. In these cases, each of the organic photoreceptors has a protective layer as an outermost layer. Therefore, it is easier to control a difference in universal hardness between the organic photoreceptors A and B in two adjacent image forming units including toners having different colors within a range satisfying the above formula (1).

Incidentally, as illustrated in FIG. 1, the organic photoreceptor 100 may have an intermediate layer 102 between the conductive support 101 and the charge generating layer 103*a*.

Hereinafter, each layer constituting an organic photoreceptor will be described in detail.

[Protective Layer]

An organic photoreceptor preferably has a protective layer as an outermost surface layer on the opposite side to a side of a conductive support. The protective layer improves abrasion resistance and scratch resistance of a surface of the organic photoreceptor, reduces occurrence of slipping of a toner, and contributes to prolongation of the lifetime of the organic photoreceptor, eventually prolongation of the lifetime of an electrophotographic image forming device.

In the tandem type electrophotographic image forming device according to the embodiment of the present invention, at least one organic photoreceptor preferably further has a protective layer on an outermost surface. A universal hardness (HU) measured from a side of an outermost surface layer (side of protective layer) of the organic photoreceptor having the protective layer as an outermost surface is not particularly limited, but is preferably 220 $N/mm^2$ to 320 $N/mm^2$, more preferably 220 to 300 $N/mm^2$, and still more preferably 220 to 280 $N/mm^2$. Within the above range, it is more difficult to generate scratches with respect to a rubbing force of a cleaning blade, and it is possible to refresh a surface more appropriately. Note that methods for measuring and calculating the universal hardness are similar to those described above.

The thickness of the protective layer is not particularly limited, but is preferably 0.2 to 10 μm, and more preferably 0.5 to 6 μm.

The universal hardness measured from a side of an outermost surface layer (side of protective layer) of the organic photoreceptor having the protective layer as an outermost surface can be controlled by adjusting the kind and content of a material constituting the protective layer and conditions thereof and the like in a case where a polymerization reaction is performed. Note that the protective layer preferably contains a cured resin component described later, and a polymerization reaction for obtaining a cured resin is more preferably performed in the presence of a specific radical scavenger described later from a viewpoint of setting the universal hardness within the above range. This is because use of a specific radical scavenger makes it possible to adjust a crosslinking reaction in the polymerization reaction, and to easily control the crosslinking density (that is, universal hardness) of a polymer.

Hereinafter, each component for a protective layer forming material will be described in detail.

(Component of Cured Resin)

The protective layer preferably contains a cured resin component which is a cured product of a polymerizable compound from viewpoints of abrasion resistance and scratch resistance. The cured resin component constituting the protective layer is obtained by polymerizing and curing a polymerizable compound by irradiation with an actinic ray such as an ultraviolet ray or an electron beam. As the polymerizable compound, a monomer (multifunctional polymerizable compound) having two or more polymerizable functional groups may be used, and a monomer (monofunctional polymerizable compound) having one polymerizable functional group may be used in combination. Specific examples of the polymerizable compound include a styrene-based monomer, a (meth)acrylic monomer, a vinyl toluene-based monomer, a vinyl acetate-based monomer, and an N-vinylpyrrolidone-based monomer.

The polymerizable compound is particularly preferably a (meth)acrylic monomer having two or more acryloyl groups ($CH_2{=}CHCO{-}$) or methacryloyl groups ($CH_2{=}CCH_3CO{-}$) or an oligomer thereof because curing is possible with a small amount of light or in a short time.

In the present invention, the polymerizable compounds may be used singly or in admixture. In addition, these polymerizable compounds may be used in a form of a monomer or an oligomer.

Hereinafter, preferable specific examples of the polymerizable compound will be illustrated.

[Chemical formula 1]

M1

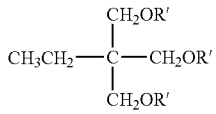

M2

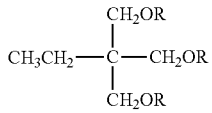

M3

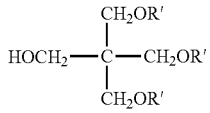

M4

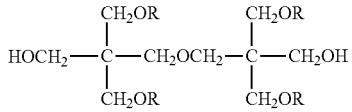

M5

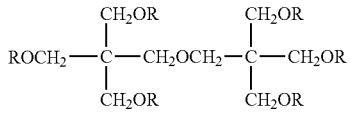

M6

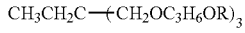

M7

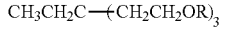

[Chemical formula 2]

M8

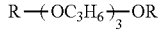

M9

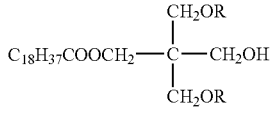

M10

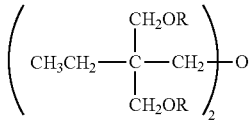

M11

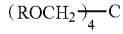

-continued

M12

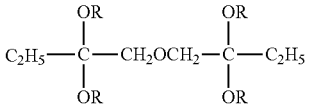

M13

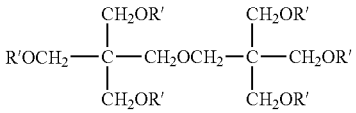

M14

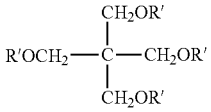

Here, in the above chemical formulas representing exemplified compounds (M1) to (M14), R represents an acryloyl group ($CH_2{=}CHCO{-}$), and R' represents a methacryloyl group ($CH_2{=}CCH_3CO{-}$).

The polymerizable compound is preferably a monomer having three or more polymerizable functional groups. As the polymerizable compound, two or more compounds may be used in combination, but also in this case, a monomer having three or more polymerizable functional groups is preferably used in a ratio of 50% by mass or more.

These polymerizable compounds and cured resin components may be used singly or in admixture of two or more kinds thereof.

(Metal Oxide Particles)

The protective layer preferably contains metal oxide particles.

The metal oxide particles contribute to image quality stability obtained by improving the strength of the protective layer and adjusting resistance.

The number average primary particle diameter of the metal oxide particles is preferably 1 to 300 nm, more preferably 3 to 100 nm, and still more preferably 5 to 40 nm.

The number average primary particle diameter of the metal oxide particles can be determined by photographing an enlarged photograph at a magnification of 10000 times with a scanning electron microscope (manufactured by JEOL Ltd.), capturing randomly selected 300 particles by a scanner to obtain a photographic image (except for aggregated particles), and calculating a number average primary particle diameter of the particles using an automatic image processing analyzer "(LUZEX AP (Software Version Ver. 1.32)" (manufactured by Nireco Corporation).

Examples of the metal oxide particles constituting the protective layer include silica (silicon oxide), magnesium oxide, zinc oxide, lead oxide, alumina (aluminum oxide), zirconium oxide, tin oxide, titania (titanium oxide), niobium oxide, molybdenum oxide, and vanadium oxide. Among these metal oxides, tin oxide is preferable from a viewpoint of electric characteristics.

The metal oxide particles are not particularly limited, and particles manufactured by a known manufacturing method can be used.

The metal oxide particles may be surface-modified with a surface modifier having a reactive organic group (hereinafter, also referred to as "reactive organic group-containing surface modifier").

The reactive organic group-containing surface modifier preferably reacts with a hydroxy group or the like present on surfaces of metal oxide particles, and examples of such a reactive organic group-containing surface modifier include a silane coupling agent and a titanium coupling agent.

In addition, the reactive organic group-containing surface modifier preferably has a radically polymerizable reactive group. Examples of the radically polymerizable reactive group include a vinyl group, an acryloyl group, and a methacryloyl group. Such a radically polymerizable reactive group can also react with a polymerizable compound to form a strong protective layer. The surface modifier having a radically polymerizable reactive group is preferably a silane coupling agent having a radically polymerizable reactive group such as a vinyl group, an acryloyl group, or a methacryloyl group.

The reactive organic group-containing surface modifier is preferably a silane coupling agent having the above radically polymerizable group, and examples thereof include the following compounds S-1 to S-31.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)(OCH_3)_2$

As the reactive organic group-containing surface modifier, a silane compound having a radically polymerizable reactive organic group may be used in addition to those represented by the above exemplified compounds (S-1) to (S-31). The reactive organic group-containing surface modifiers may be used singly or in admixture of two or more kinds thereof. The treatment amount (addition amount) of the reactive organic group-containing surface modifier is preferably 0.1 to 200 parts by mass, and more preferably 7 to 70 parts by mass relative to 100 parts by mass of particles.

A method for treating untreated metal oxide particles with the reactive organic group-containing surface modifier is not particularly limited, but examples thereof include a method for wet-disintegrating a slurry (suspension of solid particles) containing untreated metal oxide particles and a reactive organic group-containing surface modifier. By this method, surface modification of untreated metal oxide particles proceeds while reaggregation of the untreated metal oxide particles is prevented Thereafter, a solvent is removed, and the resulting product is powdered.

Examples of a surface modifying device include a wet medium dispersion type device. In this wet medium dispersion type device, beads are filled as a medium in a container, a stirring disk attached perpendicular to a rotation axis is rotated at a high speed, and aggregated particles of untreated metal oxide particles are thereby crushed to perform pulverization and dispersion. The wet medium dispersion type device is not limited as long as being able to sufficiently disperse untreated metal oxide particles and to modify a surface when the untreated metal oxide particles are surface-modified. Examples thereof include various types of devices such as a vertical type device, a horizontal type device, a continuous type device, and a batch type device. Specific examples thereof include a sand mill, an ultra visco mill, a pearl mill, a glen mill, a dyno mill, an agitator mill, and a dynamic mill. These dispersion type devices perform fine pulverization and dispersion by impact crushing, friction, shearing, shear stress, and the like using a pulverizing medium such as balls or beads.

As the beads used in the wet medium dispersion type device, balls made of glass, alumina, zircon, zirconia, steel, flintstone, or the like can be used, and beads made of zirconia or zircon are particularly preferable. In addition, as the sizes of the beads, beads each having a diameter of about 1 to 2 mm are usually used. However, beads each having a diameter of about 0.1 to 1.0 mm are preferably used.

Various materials such as stainless steel, nylon, and ceramic can be used for a disk and an inner wall of a container used for the wet medium dispersion type device. However, a disk and an inner wall of a container, made of ceramic such as zirconia or silicon carbide, are particularly preferable.

These metal oxide particles may be used singly or in admixture of two or more kinds thereof.

The content of the metal oxide particles is not particularly limited, but is preferably 100 to 200 parts by mass, and more preferably 110 to 170 parts by mass relative to 100 parts by mass of a polymerizable compound for constituting a cured resin component. Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

(Charge Transporting Material)

The protective layer preferably contains a charge transporting material. The charge transporting material has a charge transporting property of transporting a charge carrier in the protective layer.

The charge transporting material can be appropriately selected from known compounds. However, the protective layer preferably contains a charge transporting material, for example, having a structure represented by the following general formula (1) from viewpoints of scratch resistance, charge injection characteristics, low transfer memory generation probability, and the like.

[Chemical formula 3]

General formula (1)

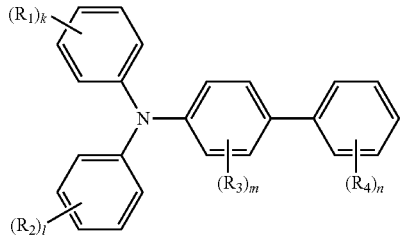

In the above general formula (1), $R_1$, $R_2$, $R_3$, and $R_4$ each independently represent an alkyl group having 1 to 7 carbon atoms or an alkoxy group having 1 to 7 carbon atoms. k, l, and n each independently represent an integer of 0 to 5, and m represents an integer of 0 to 4. However, in a case where k, l, n, or m is 2 or more, a plurality of $R_1$s may be the same as or different from one another, a plurality of $R_2$s may be the same as or different from one another, a plurality of $R_3$s may be the same as or different from one another, and a plurality of $R_4$s may be the same as or different from one another. Among these compounds, $R_1$, $R_2$, $R_3$, and $R_4$ preferably each independently represent an alkyl group having 1 to 3 carbon atoms. k, l, n, and m preferably each independently represent an integer of 0 or 1. Examples of a preferable compound include CTM-1 used in Examples.

As the compound represented by the above general formula (1), for example, those described in JP 2015-114454 A can be used. In addition, the compound represented by the above general formula (1) can be synthesized by a known synthesis method, for example, a method disclosed in JP 2006-143720 A.

These charge transporting materials may be used singly or in admixture of two or more kinds thereof.

The addition amount of the charge transporting material is not particularly limited, but is preferably 1 to 25 parts by mass, and more preferably 5 to 20 parts by mass relative to 100 parts by mass of a polymerizable compound for constituting a cured resin component. Within the above range, electric characteristics are further improved, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

Note that the hardness of the protective layer, that is, the universal hardness (HU) measured from a side of an outermost surface layer (side of protective layer) of an organic photoreceptor having the protective layer as an outermost surface is preferably controlled by a volume ratio between a polymerizable compound for constituting a cured resin component and a charge transporting agent. Here, by increasing a volume ratio of the polymerizable compound and reducing a volume ratio of the charge transporting agent when the total volume of a protective layer forming material is assumed to be 100, a value of the universal hardness can be increased.

(Specific Radical Scavenger)

The protective layer preferably contains a radical scavenger having a structure represented by the following general formula (2).

The above polymerizable compound is preferably polymerized in the presence of a specific radical scavenger represented by the following general formula (2). This specific radical scavenger functions as a sealant of a crosslinking bond. That is, a specific radical scavenger can adjust a crosslinking density (that is, universal hardness) depending on an addition ratio or the like of the radical scavenger. Therefore, a cured resin component is obtained by polymerizing a polymerizable compound in the presence of a specific radical scavenger. As a result, the protective layer has an appropriate film strength (abrasion resistance), and a surface of an organic photoreceptor is appropriately depleted by a cleaner such as a cleaning blade. Therefore, even if a discharge product or the like is attached to a surface of a photoreceptor, the surface of the organic photoreceptor is depleted and refreshed. Therefore, an image flow in a formed image can be prevented.

[Chemical formula 4]

General formula (2)

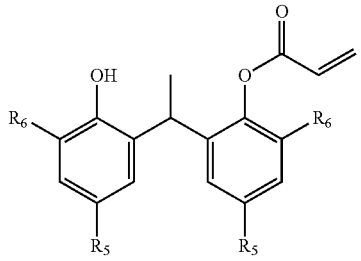

In the above general formula (2), $R_5$ and $R_6$ each independently represent an alkyl group having 1 to 6 carbon atoms. If each of $R_5$ and $R_6$ is an alkyl group having 1 to 6 carbon atoms, an influence of steric hindrance of a radical scavenger can be reduced, and a crosslinking reaction can be controlled easily. $R_5$ and $R_6$ each independently represent preferably an alkyl group having 4 or 5 carbon atoms, more preferably a tert-butyl group or a tert-pentyl group, and still more preferably a tert-pentyl group from a viewpoint of stability of a captured radical. These specific radical scavengers may be used singly or in admixture of two or more kinds thereof.

As the specific radical scavenger, either a synthesized product or a commercially available product may be used, and examples of the commercially available product include Sumilizer (registered trademark) GS manufactured by Sumitomo Chemical Co., Ltd.

The addition amount of the specific radical scavenger is not particularly limited, but is preferably 1 to 30 parts by mass, and more preferably 2 to 125 parts by mass relative to 100 parts by mass of a polymerizable compound for constituting a cured resin component. Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

Note that the hardness of the protective layer, that is, the universal hardness (HU) measured from a side of an outermost surface layer (side of protective layer) of an organic photoreceptor having the protective layer as an outermost surface is particularly preferably controlled by a volume ratio between a polymerizable compound for constituting a cured resin component and a specific radical scavenger. Here, by increasing a volume ratio of the polymerizable compound and reducing a volume ratio of the specific radical scavenger when the total volume of a protective layer forming material is assumed to be 100, a value of the universal hardness can be increased.

(Polymerization Initiator)

The polymerizable compound for constituting the cured resin component is preferably polymerized using a polymerization initiator.

As the polymerization initiator, a radical polymerization initiator is preferably used. The radical polymerization initiator is not particularly limited, but is preferably a photopolymerization initiator, more preferably an acylphosphine oxide compound, an alkylphenone compound, an oxime ester compound, or a thioxanthone compound, and more preferably an acylphosphine oxide compound or an oxime ester compound. These polymerization initiators may be used singly or in admixture of two or more kinds thereof.

The acylphosphine oxide compound is not particularly limited, but preferable examples thereof include the following compounds.

[Chemical formula 5]

(P1)

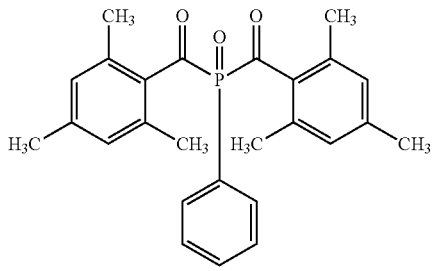

(P2)

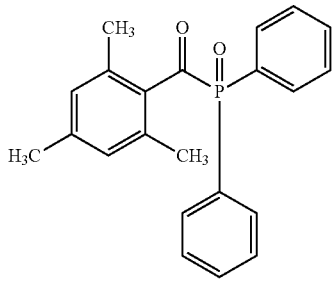

The oxime ester compound is not particularly limited, but preferable examples thereof include the following compounds.

[Chemical formula 6]

(P3)

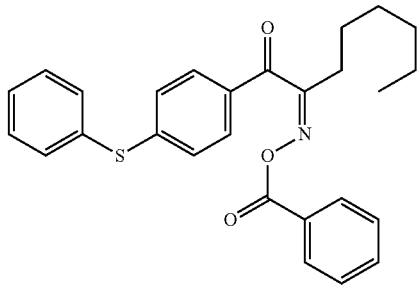

-continued (P4)

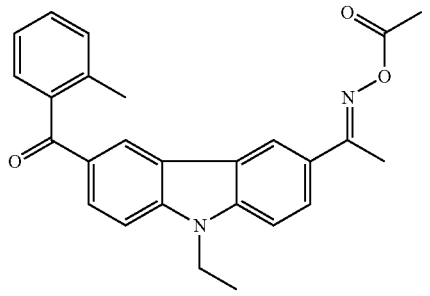

These polymerization initiators may be used singly or in admixture of two or more kinds thereof.

The content of the polymerization initiator is preferably 0.1 to 20 parts by mass, and more preferably 0.5 to 10 parts by mass relative to 100 parts by mass of the polymerizable compound. Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

(Other Components)

The protective layer may further contain other components such as an antioxidant and lubricant particles.

The antioxidant is not particularly limited, but for example, those described in JP 2000-305291 A can be preferably used.

The lubricant particles are not particularly limited, but for example, fluorine atom-containing resin particles can be added. The fluorine atom-containing resin particles are not particularly limited, but examples thereof include a tetrafluoroethylene resin, a trifluorochloroethylene resin, a hexafluorochloroethylene propylene resin, a vinyl fluoride resin, a vinylidene fluoride resin, a difluorodichloroethylene resin, and copolymers thereof. These resins can be used singly or in admixture of two or more kinds thereof. Among these resins, a tetrafluoroethylene resin and a vinylidene fluoride resin are particularly preferable.

[Conductive Support]

A conductive support constituting the organic photoreceptor is not particularly limited as long as having conductivity, and examples thereof include a product obtained by molding a metal such as aluminum, copper, chromium, nickel, zinc, or stainless steel into a drum or sheet shape, a product obtained by laminating a metal foil such as aluminum or copper on a plastic film, a product obtained by vapor-depositing aluminum, indium oxide, tin oxide, or the like on a plastic film, and a metal, a plastic film, and paper having a conductive layer disposed thereon by applying a conductive material alone or together with a binder resin.

[Intermediate Layer]

In the organic photoreceptor, an intermediate layer having a barrier function and an adhesive function can be disposed between a conductive support and an organic photosensitive layer. Considering prevention of various faults and the like, it is preferable to dispose the intermediate layer.

Such an intermediate layer contains, for example, a binder resin (hereinafter, also referred to as "intermediate layer binder resin") and, if necessary, conductive particles or metal oxide particles.

The intermediate layer binder resin is not particularly limited, and examples thereof include casein, polyvinyl alcohol, nitrocellulose, an ethylene-(meth)acrylic acid copolymer, a polyamide resin, a polyurethane resin, and gelatin. Among these compounds, an alcohol-soluble polyamide resin is preferable. These intermediate layer binder resins may be used singly or in admixture of two or more kinds thereof.

The intermediate layer can contain various conductive particles and metal oxide particles in order to adjust resistance. For example, various metal oxide particles such as alumina, zinc oxide, titanium oxide, tin oxide, antimony oxide, indium oxide, and bismuth oxide can be used. In addition, ultrafine particles such as indium oxide doped with tin or tin oxide and zirconium oxide doped with antimony can be used.

The number average primary particle diameter of such metal oxide particles is preferably 0.3 μm or less, and more preferably 0.1 μm or less.

These metal oxide particles may be used singly or in admixture of two or more kinds thereof. In a case where two or more kinds of the metal oxide particles are mixed, the particles may be in a form of solid solution or fusion.

The content of the conductive particles or the metal oxide particles is preferably 20 to 400 parts by mass, and more preferably 50 to 350 parts by mass relative to 100 parts by mass of the binder resin.

The thickness of the intermediate layer is preferably 0.1 to 15 μm, and more preferably 0.3 to 10 μm.

[Charge Generating Layer]

A charge generating layer in an organic photosensitive layer constituting an organic photoreceptor contains a charge generating material and a binder resin (hereinafter, also referred to as "charge generating layer binder resin").

Examples of the charge generating material include: an azo raw material such as Sudan Red or Diane Blue; a quinone pigment such as pyrenequinone or anthanthrone; a quinocyanine pigment; a perylene pigment; an indigo pigment such as indigo or thioindigo; a polycyclic quinone pigment such as pyranthrone or diphthaloyl pyrene; and a phthalocyanine pigment, but are not limited thereto. Among these materials, a polycyclic quinone pigment and a titanyl phthalocyanine pigment are preferable. These charge generating materials may be used singly or in admixture of two or more kinds thereof.

As the charge generating layer binder resin, a known resin can be used, and examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing two or more of these resins (for example, a vinyl chloride-vinyl acetate copolymer resin or a vinyl chloride-vinyl acetate-maleic anhydride copolymer resin), and a polyvinyl carbazole resin, but are not limited thereto. Among these resins, a polyvinyl butyral resin is preferable. These charge generating layer binder resins may be used singly or in admixture of two or more kinds thereof.

The content of the charge generating material in the charge generating layer is preferably 1 to 600 parts by mass, and more preferably 50 to 500 parts by mass relative to 100 parts by mass of the charge generating layer binder resin.

The thickness of the charge generating layer varies depending on characteristics of the charge generating material, characteristics of the charge generating layer binder resin, the content thereof, and the like, but is preferably 0.01 to 5 μm, and more preferably 0.05 to 3 μm.

[Charge Transporting Layer]

A charge transporting layer in an organic photosensitive layer constituting an organic photoreceptor contains a charge transporting material and a binder resin (hereinafter, also referred to as "charge transporting layer binder resin").

Examples of a charge transporting material of the charge transporting layer include a triphenylamine derivative, a hydrazone compound, a styryl compound, a benzidine compound, and a butadiene compound as a material that transports a charge (hole).

The charge transporting layer formed under a protective layer preferably contains a charge transporting material having a high mobility and a large molecular weight. As such a charge transporting material, a compound different from the compound represented by the above general formula (1) is preferably used.

As the charge transporting layer binder resin, a known resin can be used, and examples thereof include a polycarbonate resin, a poly(meth)acrylate resin, a polyester resin, a polystyrene resin, a styrene-(meth)acrylonitrile copolymer resin, a poly(meth)acrylate resin, and a styrene-(meth)acrylate copolymer resin, but a polycarbonate resin is preferable. Furthermore, for example, polycarbonate resins of a bisphenol A (BPA) type, a bisphenol Z (BPZ) type, a dimethyl BPA type, and a BPA-dimethyl BPA copolymer type are preferable from viewpoints of crack resistance, abrasion resistance, and charging characteristics. These charge transporting layer binder resins may be used singly or in admixture of two or more kinds thereof.

The content of the charge transporting material in the charge transporting layer is preferably 10 to 500 parts by mass, and more preferably 20 to 250 parts by mass relative to 100 parts by mass of the charge transporting layer binder resin.

The thickness of the charge transporting layer varies depending on characteristics of the charge transporting material, characteristics of the charge transporting layer binder resin, the content thereof, and the like, but is preferably 5 to 40 μm, and more preferably 10 to 30 μm.

The charge transporting layer may contain an antioxidant, an electron conducting agent, a stabilizer, a silicone oil, or the like. An antioxidant disclosed in JP 2000-305291 A is preferable, and electronic conducting agents disclosed in JP 50-137543 A, JP 58-76483 A, and the like are preferable.

[Method for Manufacturing Organic Photoreceptor]

The organic photoreceptor is not particularly limited, but is preferably manufactured by a manufacturing method including the following steps.

Step (1): a step of applying an intermediate layer forming coating liquid onto an outer peripheral surface of a conductive support, if necessary, and drying the coating liquid to form an intermediate layer;

Step (2): a step of applying a charge generating layer forming coating liquid onto an outer peripheral surface of the conductive support or onto an outer peripheral surface of the intermediate layer formed on the conductive support in step (1), and drying the coating liquid to form a charge generating layer;

Step (3): a step of applying a charge transporting layer forming coating liquid onto an outer peripheral surface of the charge generating layer formed on the intermediate layer, and drying the coating liquid to form a charge transporting layer; and Step (4): a step of, if necessary, applying a protective layer forming coating liquid onto an outer peripheral surface of the charge transporting layer formed on the charge generating layer and performing polymerization and curing to form a protective layer.

The concentration of each component in a coating liquid for forming each layer is appropriately selected depending on the thickness of each layer and a manufacturing rate.

Examples of a disperser that disperses particles such as conductive particles and metal oxide particles, a charge generating material, and the like in a coating liquid for forming each layer include an ultrasonic dispersing machine, a ball mill, a sand mill, and a homomixer, but are not limited thereto.

A method for applying a coating liquid for forming each layer is not particularly limited, but examples thereof include a known method such as a dip coating method, a spray coating method, a spinner coating method, a bead coating method, a blade coating method, a beam coating method, a slide hopper method, or a circular slide hopper method.

A method for drying a coating film can be appropriately selected depending on the kind of a solvent and a layer thickness, but thermal drying is preferable.

Hereinafter, a step of forming each layer will be described in detail.

(Step (1): Formation of Intermediate Layer)

An intermediate layer can be formed by dissolving an intermediate layer binder resin in a solvent to prepare a coating liquid (hereinafter, also referred to as "intermediate layer forming coating liquid"), dispersing conductive particles and metal oxide particles therein, if necessary, then applying the coating liquid onto a conductive support at a constant layer thickness to form a coating film, and drying the coating film.

The intermediate layer forming coating liquid is preferably applied by a dip coating method.

The solvent used in the step of forming an intermediate layer is preferably a solvent that favorably disperses conductive particles and metal oxide particles and dissolves the intermediate layer binder resin, particularly a polyamide resin. Specifically, an alcohol having 1 to 4 carbon atoms, such as methanol, ethanol, n-propyl alcohol, isopropyl alcohol, n-butanol, tert-butanol, or sec-butanol (2-butanol) is preferable because of excellent dissolubility for a polyamide resin and excellent coating performance. Examples of a co-solvent that can be used in combination with the above-described solvent and can obtain a preferable effect in order to improve storage stability and dispersibility of particles include benzyl alcohol, toluene, dichloromethane, cyclohexanone, and tetrahydrofuran.

(Step (2): Formation of Charge Generating Layer)

The charge generating layer can be formed by dispersing a charge generating material in a solution in which a charge generating layer binder resin is dissolved in a solvent to prepare a coating liquid (hereinafter, also referred to as "charge generating layer forming coating liquid"), applying the coating liquid onto the intermediate layer at a constant layer thickness to form a coating film, and drying the coating film.

The charge generating layer forming coating liquid is preferably applied by a dip coating method.

Examples of a solvent used for forming the charge generating layer include toluene, xylene, dichloromethane, 1,2-dichloroethane, methyl ethyl ketone, cyclohexane, ethyl acetate, tert-butyl acetate, methanol, ethanol, n-propyl alcohol, isopropyl alcohol, n-butanol, tert-butanol, sec-butanol (2-butanol), methyl cellosolve, 4-methoxy-4-methyl-2-pentanone, ethyl cellosolve, tetrahydrofuran, 1,4-dioxane, 1,3-dioxolane, pyridine, and diethylamine, but are not limited thereto.

(Step (3): Formation of Charge Transporting Layer)

The charge transporting layer can be formed by preparing a coating liquid (hereinafter, also referred to as "charge transporting layer forming coating liquid") in which a charge transporting layer binder resin, a charge transporting material, and the like are dissolved in a solvent, applying the coating liquid onto the charge generating layer at a constant layer thickness to form a coating film, and drying the coating film.

The charge generating layer forming coating liquid is preferably applied by a slide hopper method using a circular slide hopper application apparatus, and can be applied by a method disclosed in, for example, JP 2015-114454 A.

Examples of a solvent used for forming the charge transporting layer include toluene, xylene, dichloromethane, 1,2-dichloroethane, methyl ethyl ketone, cyclohexanone, ethyl acetate, butyl acetate, methanol, ethanol, n-propyl alcohol, isopropyl alcohol, n-butanol, tert-butanol, sec-butanol (2-butanol), tetrahydrofuran, 1,4-dioxane, 1,3-dioxolane, pyridine, and diethylamine, but are not limited thereto.

(Step (4): Formation of Protective Layer)

The protective layer can be formed by adding a polymerizable compound and, if necessary, other components such as metal oxide particles, a polymerization initiator, a specific radical scavenger, and a charge transporting material to a known solvent to prepare a coating liquid (hereinafter, also referred to as "protective layer forming coating liquid"), applying this protective layer forming coating liquid onto an outer peripheral surface of the charge transporting layer formed in step (3) to form a coating film, drying this coating liquid, and irradiating this coating liquid with an actinic ray such as an ultraviolet ray or an electron beam to polymerize and cure a polymerizable compound component in the coating film.

The protective layer is preferably formed such that the universal hardness of an organic photoreceptor is within a desired range by appropriately controlling the kinds and contents of a polymerizable compound and optionally added metal oxide particles, polymerization initiator, specific radical scavenger, charge transporting material, and the like, polymerization reaction conditions, and the like.

The protective layer forming coating liquid is preferably applied by a slide hopper method using a circular slide hopper application apparatus, and can be applied by a method disclosed in, for example, JP 2015-114454 A.

As a solvent used for forming the protective layer, any solvent can be used as long as being able to dissolve or disperse a polymerizable compound, metal oxide particles, and the like. Examples thereof include methanol, ethanol, n-propyl alcohol, isopropyl alcohol, n-butanol, tert-butanol, sec butanol (2-butanol), benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine, but are not limited thereto.

A method for causing a polymerizable compound to react is not particularly limited, and examples thereof include a method for causing a reaction by electron beam cleavage and a method for causing a reaction with light or heat by adding a radical polymerization initiator.

A cured resin component is generated by irradiating a coating film with an actinic ray as a curing treatment, generating radicals to perform polymerization, and forming a crosslinking bond between molecules and within a molecule by a crosslinking reaction to perform curing. As the actinic ray, an ultraviolet ray and an electron beam are more preferable, and an ultraviolet ray is particularly preferable because of easiness in use.

As a light source of an ultraviolet ray, any light source that generates an ultraviolet ray can be used without limitation. Examples of the light source include a low-pressure mercury lamp, a medium-pressure mercury lamp, a high-pressure mercury lamp, an extra high-pressure mercury lamp, a carbon arc lamp, a metal halide lamp, a xenon lamp, and a flash (pulse) xenon lamp.

Irradiation conditions vary depending on a lamp, but an irradiation dose of an actinic ray is preferably 5 to 500 $mJ/cm^2$, and more preferably 5 to 100 $mJ/cm^2$.

The electric power of a lamp is preferably 0.1 to 5 kW, more preferably 0.5 to 4 kW, and still more preferably 0.5 to 3 kW.

Irradiation time for obtaining a required irradiation dose of an actinic ray is preferably 0.1 seconds to 10 minutes, and more preferably 0.1 seconds to 5 minutes from a viewpoint of operation efficiency.

In the step of forming a protective layer, drying can be performed before and after irradiation with an actinic ray and during irradiation with an actinic ray, and the timing of drying can be appropriately selected by combining these.

<Electrophotographic Image Forming Device>

The electrophotographic image forming device according to the embodiment of the present invention is a tandem type electrophotographic image forming device using an organic photoreceptor obtained by sequentially laminating at least a charge generating layer and a charge transporting layer on a conductive support, including a plurality of image forming units each including at least: an electrostatic latent image former that forms an electrostatic latent image on the organic photoreceptor; a developer that supplies a toner to the organic photoreceptor and develops the electrostatic latent image to form a toner image; a lubricant supplier that supplies a lubricant to a surface of the organic photoreceptor; and a cleaner that removes a toner remaining on the surface of the organic photoreceptor with a cleaning blade Here, the electrophotographic image forming device preferably further includes a charger that charges a surface of the organic photoreceptor. The electrostatic latent image former is preferably an exposurer that exposes the organic photoreceptor charged by the charger to form an electrostatic latent image. In addition, the electrophotographic image forming device preferably further includes a transferer that transfers a toner image formed on the organic photoreceptor. That is, the electrophotographic image forming device according to the embodiment of the present invention particularly preferably includes at least the above-described charger, exposurer (electrostatic latent image former), developer, transferer, lubricant supplier, and cleaner.

[Disposition of Image Forming Unit and Organic Photoreceptor]

The electrophotographic image forming device according to the embodiment of the present invention has two or more image forming units including toners having different colors. The number of the image forming units is preferably three or more, and more preferably four or more. The electrophotographic image forming device preferably has eight or less image forming units including toners having different colors. Among these image forming devices, the electrophotographic image forming device particularly preferably has four image forming units including toners having different colors. Therefore, the electrophotographic image forming device according to the embodiment of the present invention has one or more combinations each composed of two adjacent image forming units including toners having different colors, preferably has two or more of the combinations, and more preferably has three or more of the combinations. The electrophotographic image forming device preferably has seven or less combinations each composed of two adjacent image forming units including toners having different colors. Among these image forming devices, the electrophotographic image forming device particularly preferably has three combinations each composed of two adjacent image forming units including toners having different colors. Within the above range, an effect of the present invention is further exerted.

In the electrophotographic image forming device according to the embodiment of the present invention, at least one combination composed of two adjacent image forming units including toners having different colors satisfies the following formula (1) if the universal hardness of an organic photoreceptor A included in an image forming unit disposed on an upstream side is represented by Ha, and the universal hardness of an organic photoreceptor B included in an image forming unit disposed on a downstream side is represented by Hb.

[Numerical formula 3]

$$Hb-Ha \geq 10\ \mathrm{N/mm^2} \quad (1)$$

If a difference obtained by subtracting Ha from Hb is less than 10 $N/mm^2$ in all the combinations each composed of two adjacent image forming units including toners having different colors, the hardness of the organic photoreceptor B having a relatively small amount of lubricant on the organic photoreceptor may be lowered, and a surface of a protective layer may be damaged. For this reason, the lifetime of the organic photoreceptor may be shortened, and slipping of a toner may occur. Alternatively, the hardness of the organic photoreceptor A having a relatively large amount of lubricant on the organic photoreceptor may be increased, the amount of depletion may be excessively small, and cleaning failure may occur on a surface of the organic photoreceptor. For this reason, the lifetime of the organic photoreceptor may be shortened, and an image flow in a formed image may occur. These problems may occur at the same time. In order to suppress occurrence of these problems, in at least one combination composed of two adjacent image forming units including toners having different colors, as represented by formula (1), a difference obtained by subtracting Ha from Hb is required to be 10 $NT/mm^2$ or more.

In at least one combination composed of two adjacent image forming units, the difference obtained by subtracting Ha from Hb is preferably 10 to 140 $N/mm^2$, more preferably 10 to 70 $N/mm^2$, still more preferably 10 to 40 $N/mm^2$, particularly preferably 10 to 30 $N/mm^2$, and most preferably 25 to 30 $N/mm^2$. Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved. Particularly, if the difference is the upper limit value or less, in an organic photoreceptor MU included in an image forming unit disposed in the most upstream, an organic photoreceptor MD included in an image forming unit disposed in the most downstream, or both of MU and MD, an effect of suppressing an image flow and an effect of reducing the frequency of occurrence of slipping of a toner are remarkable.

In the electrophotographic image forming device according to the embodiment of the present invention, three or more image forming units each include an electrostatic latent image former, a developer, a lubricant supplier, and a cleaner. Preferably, at least two combinations each composed of two adjacent image forming units including toners having different colors satisfy the above formula (1). More preferable, at least three combinations each composed of two adjacent image forming units including toners having different colors satisfy the above formula (1). Still more preferably, all the combinations each composed of two adjacent image forming units including toners having different colors satisfy the above formula (1). Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

In the electrophotographic image forming device according to the embodiment of the present invention, in a case where there is a combination that does not satisfy the above formula (1) among the combinations each composed of two adjacent image forming units including toners having different colors, all the combinations that do not satisfy the above formula (1) preferably satisfy the following formula (2).

[Numerical formula 4]

$$Hb \geq Ha \quad (2)$$

In the electrophotographic image forming device according to the embodiment of the present invention, at least one of the organic photoreceptors B is preferably for black. At least one of the organic photoreceptors A is preferably for a chromatic color. This is because by disposing an organic photoreceptor for black which is a darker color on a downstream side, an inner side is colored with a darker color in a formed image to improve image quality. In addition, this is because a reverse transfer toner to be reverse-transferred onto an organic photoreceptor for black which is a darker color has a lighter color, and therefore an influence on image quality by the reverse transfer toner can be reduced.

In the electrophotographic image forming device according to the embodiment of the present invention, a universal hardness Hmu of the organic photoreceptor MU included in an image forming unit disposed at the most upstream and a universal hardness Hmd of the organic photoreceptor MD included in an image forming unit disposed at the most downstream preferably satisfy the following formula (3).

[Numerical formula 5]

$$Hmd-Hmu \geq 10\ \mathrm{N/mm^2} \quad (3)$$

A difference obtained by subtracting Hmu from Hmd, represented by the above formula (3) is more preferably 10 to 140 $N/mm^2$, still more preferably 30 to 120 $N/mm^2$, particularly preferably 30 to 60 $N/mm^2$, and most preferably 40 to 60 $N/mm^2$. Within the above range, the lifetime of an organic photoreceptor, eventually the lifetime of an electrophotographic image forming device is prolonged, an effect of suppressing an image flow in a formed image is further improved, and an effect of reducing the frequency of occurrence of slipping of a toner is further improved.

[Configuration of Electrophotographic Image Forming Device]

Hereinafter, the electrophotographic image forming device according to the embodiment of the present invention will be described with reference to the attached drawings. However, the present invention is not limited only to the embodiment described below.

Figure 2:
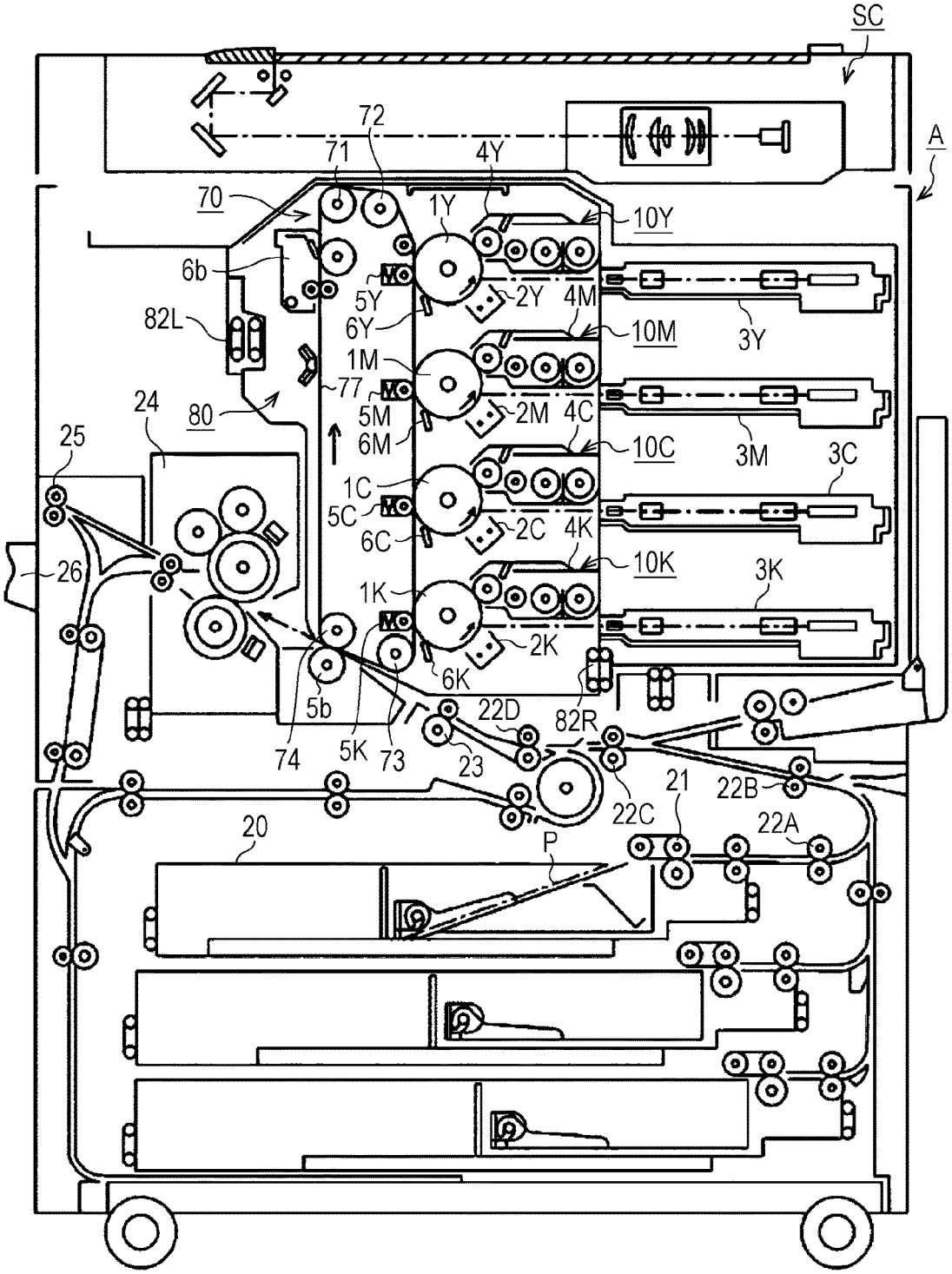
FIG. 2 is a schematic cross-sectional view illustrating a structure of the tandem type electrophotographic image forming device according to the embodiment of the present invention.
Figure 3:
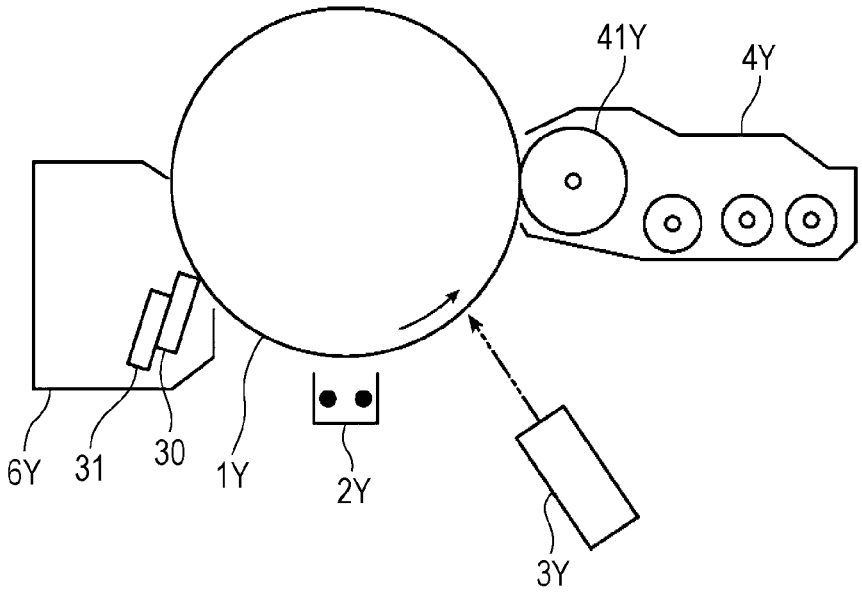
FIG. 3 is an enlarged schematic view illustrating a disposition relationship between the organic photoreceptor and a cleaning blade in the tandem type electrophotographic image forming device according to the embodiment of the present invention.

FIG. 2 is a schematic cross-sectional view illustrating a structure of the tandem type electrophotographic image forming device according to the embodiment of the present invention, and FIG. 3 is an enlarged schematic view illustrating a disposition relationship between an organic photoreceptor and a cleaning blade in the tandem type electrophotographic image forming device according to the embodiment of the present invention.

This electrophotographic image forming device is referred to as a tandem type color image forming device and includes four sets of image forming units 10Y, 10M, 10C, and 10K, an intermediate transfer body unit 70, a sheet feeder 21, and a fixer 24. An original image reading device SC is disposed above a main body A of the electrophotographic image forming device.

The four image forming units 10Y, 10M, 10C, and 10K include, around photoreceptors 1Y, 1M, 1C, and 1K, chargers 2Y, 2M, 2C, and 2K, exposurers 3Y, 3M, 3C, and 3K, rotating developers 4Y, 4M, 4C, and 4K, primary transfer rollers 5Y, 5M, 5C, 5K as primary transferers, and cleaners 6Y, 6M, 6C, and 6K that clean the photoreceptors 1Y, 1M, 1C, and 1K, respectively.

Note that the electrophotographic image forming device according to the embodiment of the present invention uses the above-described organic photoreceptor as each of the photoreceptors 1Y, 1M, 1C, and 1K.

The image forming units 10Y, 10M, 10C, and 10K have the same configuration except that the colors of toners included therein are a yellow (Y) color, a magenta (M) color, a cyan (C) color, and a black (K) color which are different from one another, respectively. Therefore, hereinafter, the image forming unit 10Y will be described in detail as an example.

The image forming unit 10Y includes the charger 2Y, the exposurer 3Y, the developer 4Y, and the cleaner 6Y around the photoreceptor 1Y which is an image forming body, and forms a yellow (Y) toner image on the photoreceptor 1Y.

The charger 2Y uniformly and negatively charges a surface of the photoreceptor 1Y. Examples of the charger 2Y include a corona discharge type charger.

The exposurer 3Y performs exposure on the photoreceptor 1Y to which a uniform potential has been applied by the charger 2Y based on an image signal (yellow) to form an electrostatic latent image corresponding to a yellow image. Examples of the exposurer 3Y include an exposurer including an LED in which light emitting elements are arrayed in an axial direction of the photoreceptor 1Y and an imaging element and a laser optical system exposurer.

The developer 4Y includes a developing sleeve 41Y, for example, having a built-in magnet, holding a developing agent, and rotating, and a voltage applying device that applies a DC and/or AC bias voltage between the photoreceptor 1Y and the developing sleeve 41Y.

The developer 4Y houses a developing agent of a Y component (for example, a two-component developing agent mainly containing a toner and a magnetic carrier). The developer 4Y visualizes an electrostatic latent image by attaching a Y component toner to a surface of the photoreceptor 1Y to form a toner image. Specifically, a developing bias is applied to the developing sleeve 41Y, and a developing electric field is formed between the photoreceptor 1Y and the developing sleeve 41Y. Due to a potential difference between the photoreceptor 1Y (negative polarity) and the developing sleeve 41Y, a charged toner (negative polarity) on the developing sleeve 41Y moves to an exposed portion on a surface of the photoreceptor 1Y and is attached thereto. That is, the developer 4Y develops an electrostatic latent image by a reversal developing method.

The cleaner 6Y remove a toner remaining on a surface of the photoreceptor 1Y. The cleaner 6Y of the present embodiment includes a cleaning blade. This cleaning blade includes a support member 31 and a blade member 30 supported on the support member 31 via an adhesive layer (not illustrated). The blade member 30 is disposed in a state in which a tip thereof is oriented in a direction opposite to a rotational direction of the photoreceptor 1Y (counter direction) at a contact portion with the surface of the photoreceptor 1Y.

The support member 31 is not particularly limited and can be a conventionally known support member. Examples thereof include support members manufactured from a rigid metal, an elastic metal, a plastic, a ceramic, and the like. Among these materials, a rigid metal is preferable.

The blade member 30 is not particularly limited, but examples thereof include polyurethane, a silicone rubber, a fluorine rubber, a chloropyrene rubber, and a butadiene rubber. Among these compounds, polyurethane is preferable because it is possible to obtain an appropriate strength and flexibility that can be brought into contact with the rotating photoreceptor 1Y. The blade member 30 using polyurethane can be manufactured by, for example, mixing a dehydrated polyol with an isocyanate compound, causing a reaction of the resulting mixture in a temperature range of 100 to 120° C. for 30 to 90 minutes to prepare a prepolymer, adding a crosslinking agent to the prepolymer, and injecting the resulting mixture into a die for curing. Examples of the polyol include a polyester polyol such as polyethylene adipate or polycaprolactone. Examples of the isocyanate compound include diphenylmethane diisocyanate. Examples of the crosslinking agent include 1,4-butanediol, trimethylolpropane, ethylene glycol, and a mixture thereof.

The blade member 30 may have a cured layer at a portion in contact with the photoreceptor 1Y. By inclusion of the cured layer at the contact portion, the hardness of a main body of the blade member 30 can be easily adjusted such that flexibility is obtained to such an extent that the blade member 30 bends appropriately when the blade member 30 comes into contact with the photoreceptor 1Y. The cured layer may be a layer disposed on a surface of the blade member 30. However, the cured layer is preferably a layer obtained by processing a part of the main body of the blade member 30 from a viewpoint of enhancing durability.

In a case of using polyurethane as a base material of the blade member 30, a portion of the blade member 30 in contact with the photoreceptor 1Y is impregnated with an isocyanate compound for a predetermined time to cause a reaction between polyurethane contained in the main body of the blade member 30 with the isocyanate compound, and the reaction portion can be thereby formed as a cured layer. The cured layer thus formed contains a polymer of the polyurethane and the isocyanate compound. The polyurethane constituting the blade member 30 has a urethane bond having an active hydrogen atom. By causing a reaction between this urethane bond and the isocyanate compound with which the blade member 30 is impregnated, an allophanate bond that increases the hardness of the cured layer can be formed between the polyurethane contained in the blade member 30 and the polymer contained in the cured layer. In addition, a polymerization reaction of the isocyanate compound with which the blade member 30 is impregnated proceeds at the same time. Therefore, a thick cured layer can be formed. Even if the cured layer wears, the cured layer is thick, and therefore the good hardness of the blade member 30 can be maintained for a long period of time.

The blade member 30 preferably has an inclination angle θ with respect to a surface of the photoreceptor 1Y within a range of 5 to 20° from a viewpoint of increasing a scraping force of a residual toner to obtain higher cleaning performance. The linear pressure of the blade member 30 can be appropriately adjusted within a range of a linear pressure set in a known blade member.

The electrophotographic image forming device illustrated in FIG. 2 includes, among the components of the image forming unit 10Y, the photoreceptor 1Y, the charger 2Y, the developer 4Y, a lubricant supplier (not illustrated) described later, and the cleaner 6Y integrally supported as a process cartridge. The process cartridge may be detachable from the device main body A via a guide such as a rail.

The image forming units 10Y, 10M, 10C, and 10K are disposed vertically in cascade, and the intermediate transfer body unit 70 is disposed on the left side of the photoreceptors 1Y, 1M, 1C, and 1K in the drawing. The intermediate transfer body unit 70 includes a semiconductive endless belt-shaped intermediate transfer body 77 wound by a plurality of rollers 71, 72, 73, and 74 and rotatably supported, a secondary transfer roller 5*b* as a secondary transferer, and the cleaner 6*b*.

The image forming units 10Y, 10M, 10C, and 10K and the intermediate transfer body unit 70 are housed in a casing 80, and the casing 80 can be drawn from the device main body A via support rails 82L and 82R.

Examples of the fixer 24 include a heating roller fixing type fixer including a heating roller with a heating source therein and a pressure roller disposed while being pressure-welded such that a fixing nip portion is formed on the heating roller.

In FIG. 2, reference numeral 20 denotes a sheet feeding cassette, reference numerals 22A, 22B, 22C, and 22D denote intermediate rollers, reference numeral 23 denotes a resist roller, reference numeral 25 denotes a discharge roller, reference numeral 26 denotes a discharge tray, and reference numeral P denotes a transfer agent.

Note that the image forming device according to the embodiment of the present invention is illustrated as a color laser printer in FIG. 2, but the electrophotographic image forming device according to the embodiment of the present invention may be configured as a copying machine. In the image forming device according to the embodiment of the present invention, a light source other than a laser, for example, an LED light source can be used as an exposure light source.

In FIG. 2, as a preferable example of the image forming device according to the embodiment of the present invention, the image forming device including four image forming units corresponding to YMCK has been described. However, an image forming device further including image forming units corresponding to other colors such as a clear color, white, gold, and silver in addition to these image forming units is another preferable example.

[Lubricant Supplier]

The electrophotographic image forming device according to the embodiment of the present invention includes a lubricant supplier that supplies a lubricant to a surface of an organic photoreceptor.

The lubricant is not particularly limited, and known lubricants can be appropriately selected. However, the lubricant preferably contains a fatty acid metal salt.

The fatty acid metal salt is not particularly limited, but a metal salt of a saturated or unsaturated fatty acid having 10 or more carbon atoms is preferable. Examples thereof include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, and cadmium ricinoleate. Among these compounds, zinc stearate is preferable from viewpoints of lubricity, spreadability, and hygroscopicity.

As the fatty acid metal salt, a synthesized product or a commercially available product may be used. Examples of the commercially available product include zinc stearate S manufactured by NOF CORPORATION.

These fatty acid metal salts may be used singly or in admixture of two or more kinds thereof.

The lubricant supplier is not particularly limited, but examples thereof include a unit that supplies a lubricant by applying a solid lubricant with a brush roller (hereinafter, also referred to as "lubricant applicator").

In a case of using the lubricant applicator, for example, in the image forming unit 10Y of the electrophotographic image forming device illustrated in FIG. 2, the lubricant applicator is preferably disposed on a downstream side of the cleaner 6Y and on an upstream side of the charger 2Y in a rotational direction of the photoreceptor 1Y. However, the disposition of the lubricant applicator is not limited to the position on a downstream side of the cleaner 6Y and on an upstream side of the charger 2Y. The lubricant applicator is not particularly limited, but preferably includes, for example, a solid lubricant and a lubricant applying member formed of a brush roller. Specifically, the lubricant applicator preferably includes: a lubricant stock formed of a solid lubricant having a rectangular parallelepiped shape; a brush roller that is in contact with a surface of the photoreceptor 1Y and applies a lubricant scraped by rubbing a surface of the lubricant stock onto the surface of the photoreceptor 1Y; a pressure spring that presses the lubricant stock against the brush roller; and a drive mechanism that rotationally drives the brush roller. In the brush roller, a tip of the brush is in contact with the surface of the photoreceptor 1Y. The brush roller is preferably rotationally driven at the same speed in the same rotational direction as a rotation direction of the photoreceptor 1Y. A leveling blade that uniformly applies a lubricant supplied to the surface of the photoreceptor 1Y by the lubricant applicator may be disposed on a downstream side of the lubricant applicator and on an upstream side of the charger 2Y. Note that the lubricant applicator is not particularly limited, and any known means can be appropriately referred to. For example, JP 2016-188950 A and the like can be referred to.

The lubricant supplier is not particularly limited, but examples thereof include a supplier that supplies a fine powder lubricant externally added to toner base particles to an organic photoreceptor (for example, 1Y in the above FIGS. 2 and 3) by an action of a developing electric field formed by a developer (for example, 4Y in the above FIGS. 2 and 3) (hereinafter, also referred to as "toner supplier").

That is, the toner supplier supplies a fine powder lubricant contained in a toner to an organic photoreceptor by an action of a developing electric field formed by a developer. The toner supplier does not involve an intermediate member such as a brush roller unlike the lubricant applicator described above, and therefore is particularly preferable because the toner supplier does not cause variation in the supply amount of the lubricant due to contamination of a lubricant and contamination or deterioration of the intermediate member.

The toner supplier externally adds a fine powder lubricant as an external additive to toner base particles described later. The volume-based median diameter Dw of the fine powder lubricant is preferably 0.3 to 25 μm, and more preferably 0.5 to 20 μm. Within the above range, the size of the lubricant is appropriately small. Therefore, a force for attachment with the toner base particles is appropriately large, and movement in the developer is more difficult. This makes supply of the lubricant more sufficient. In addition, the size of the lubricant is appropriately large. Therefore, a force for attachment with the toner base particles is appropriately small, and the lubricant more easily moves onto an organic photoreceptor. This makes it possible to uniformly supply the lubricant onto an organic photoreceptor. Note that the volume-based median diameter Dw of the lubricant is obtained by performing measurement and calculation using a device connecting a data processing computer system (manufactured by Beckman Coulter, Inc.) to a Coulter Multisizer 3 (manufactured by Beckman Coulter, Inc.). In addition, it is also possible to measure the particle diameter of the lubricant externally added to toner base particles (colored particles) by a known method such as electron microscopic photography. For a method for evaluating the volume-based median diameter Dw of the fine powder lubricant, the description in paragraphs "0031", "0032", and the like of JP 2010-175701 A can be referred to. Note that the details are described in Examples.

The addition amount of the fine powder lubricant is preferably 0.01 to 0.5 part by mass, and more preferably 0.03 to 0.3 part by mass relative to the total mass of a toner. Within the above range, an effect of the present invention is further exerted while an influence of a toner on chargeability is suppressed.

Note that a method for mixing the toner base particles and the lubricant is not particularly limited, and a known method can be appropriately selected. For example, mixing can be performed using a Henschel mixer (registered trademark) manufactured by Mitsui Miike Chemical Engineering Machinery, Co., Ltd.

[Toner and Developing Agent]

Here, "toner base particles" constitute abase of "toner particles". "Toner base particles" include at least a binder resin and a colorant, and may further contain another component such as a release agent (wax) or a charge control agent, if necessary. "Toner base particles" are referred to as "toner particles" by addition of an external additive. "Toner" means an aggregate of "toner particles".

The toner is not particularly limited in the electrophotographic image forming device according to the embodiment of the present invention, and various known toners can be used.

As the toner, either a pulverized toner or a polymerized toner can be used, but the polymerized toner is preferably used from a viewpoint of obtaining a high quality image.

The average particle diameter of the toner is not particularly limited, but is preferably 2 to 8 μm in terms of volume-based median diameter. Within this range, it is possible to further increase resolution.

As described above, in a case where the lubricant supplier that supplies a fine powder lubricant contained in a toner to an organic photoreceptor by an action of a developing electric field formed by the developer is used, a fine powder lubricant can be externally added as an external additive to the toner base particles.

Inorganic particles such as silica and titania having an average particle diameter of about 10 to 300 nm and an abrasive having an average particle diameter of about 0.2 to 3 μm can be externally added as external additives to the toner base particles in appropriate amounts.

In a case where a toner is used as a two-component developing agent, as a carrier, it is possible to use magnetic particles formed of a conventionally known material, for example, a ferromagnetic metal such as iron, an alloy made of a ferromagnetic metal, aluminum, and lead, or a ferromagnetic metal compound such as ferrite or magnetite. Among these materials, ferrite is particularly preferable.

As the carrier, it is preferable to use a carrier in which magnetic particles are further coated with a resin or a so-called resin dispersion type carrier in which magnetic particles are dispersed in a resin. A resin composition for coating is not particularly limited. However, for example, a cyclohexyl methacrylate-methyl methacrylate copolymer or the like is preferably used.

The volume-based median diameter of the carrier is preferably within a range of 15 to 100 μm, and more preferably within a range of 25 to 60 μm.

The concentration of a toner contained in a two-component developing agent is preferably 4% by mass or more and 8% by mass or less.

The embodiment of the present invention has been specifically described above, but the embodiment of the present invention is not limited to the above examples, and various modifications can be made thereto.

EXAMPLES

An effect of the present invention will be described using the following Examples and Comparative Examples. In the following Examples, "parts" and '%' mean "parts by mass" and "% by mass", respectively, unless otherwise specified. Note that the present invention is not limited to the following Examples.

<Manufacture of Organic Photoreceptor>

Structural formulas of compounds used in Examples are illustrated below.

[Chemical formula 7]

Compound A

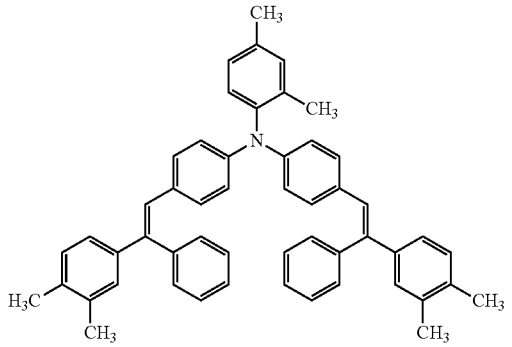

-continued

M1

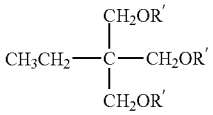

P1

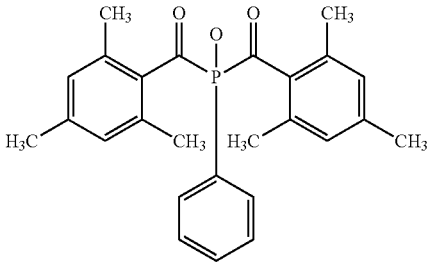

CTM-1

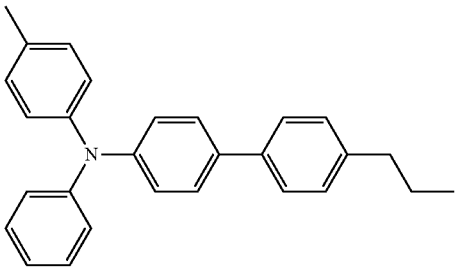

[Manufacture of Organic Photoreceptor [1]]

(Preparation of Conductive Support)

A surface of a cylindrical aluminum support having a diameter of 30 mm was cut to prepare a conductive support [1] having a finely roughened surface.

(Formation of Intermediate Layer)

A dispersion having the following composition was diluted twice with the same mixed solvent. The resulting solution was allowed to stand overnight, and then filtered (filter: Rigimesh 5 μm filter manufactured by Nihon Pall Ltd.) to prepare an intermediate layer forming coating liquid [1].

Binder resin: 1 part of polyamide resin "CM8000" (manufactured by Toray Industries, Inc.)

Metal oxide particles: 3 parts of titanium oxide "SMT500SAS" (manufactured by Tayca Corporation)

Solvent: 10 parts of methanol

Dispersing was performed for 10 hours in a batch system using a sand mill as a dispersing machine. The intermediate layer forming coating liquid [1] was applied onto the conductive support [1] by a dip coating method to form an intermediate layer [1] having a dry layer thickness of 2 μm.

(Formation of Charge Generating Layer)

Charge generating material: 20 parts of the following charge generating material (CG-1), Binder resin: 10 parts of polyvinyl butyral resin "#6000-C" (manufactured by Denka), Solvent: 700 parts of tert-butyl acetate, and Solvent: 300 parts of 4-methoxy-4-methyl-2-pentanone were mixed and dispersed using a sand mill for 10 hours to prepare a charge generating layer forming coating liquid [1]. The charge generating layer forming coating liquid [1] was applied onto the intermediate layer [1] by a dip coating method to form a charge generating layer [1] having a dry layer thickness of 0.3 μm.

(Synthesis of Charge Generating Material (CG-1))

(1) Synthesis of Amorphous Titanyl Phthalocyanine 29.2 parts by mass of 1,3-diiminoisoindoline was dispersed in 200 parts by mass of o-dichlorobenzene. 20.4 parts by mass of titanium tetra-n-butoxide was added thereto, and the resulting mixture was heated at 150 to 160° C. for five hours under a nitrogen atmosphere. The resulting solution was allowed to cool. Thereafter, the precipitated crystal was filtered, washed with chloroform, washed with a 2% hydrochloric acid aqueous solution, washed with water, washed with methanol, and dried to obtain 26.2 parts by mass (yield 91%) of crude titanyl phthalocyanine.

Subsequently, the crude titanyl phthalocyanine was stirred in 250 parts by mass of concentrated sulfuric acid at 5° C. or lower for one hour to be dissolved, and the resulting solution was poured into 5000 parts by mass of water at 20° C. The precipitated crystal was filtered and thoroughly washed with water to obtain 225 parts by mass of a wet paste product.

The wet paste product was frozen in a freezer and thawed again, and then filtered and dried to obtain 24.8 parts by mass (yield 86%) of amorphous titanyl phthalocyanine.

(2) Synthesis of (2R,3R)-2,3-Butanediol Adduct Titanyl Phthalocyanine 10.0 parts by mass of the amorphous titanyl phthalocyanine and 0.94 parts by mass (0.6 equivalent ratio) (equivalent ratio to titanyl phthalocyanine, hereinafter the same) of (2R,3R)-2,3-butanediol were mixed with 200 parts by mass of orthodichlorobenzene (ODB). The resulting mixture was heated and stirred at 60 to 70° C. for 6.0 hours. The resulting solution was allowed to stand overnight. Thereafter, methanol was added to the reaction liquid, and the resulting crystal was filtered. The crystal after filtration was washed with methanol to obtain 10.3 parts by mass of charge generating material containing (2R,3R)-2,3-butanediol adduct titanyl phthalocyanine (CG-1).

In an X-ray diffraction spectrum of the charge generating material (CG-1), there were clear peaks at 8.3°, 24.7°, 25.1°, and 26.5°. In a mass spectrum, there were peaks at 576 and 648. In an IR spectrum, absorption of Ti═O appeared near 970 $cm^{-1}$, and absorption of O—Ti—O appeared near 630 $cm^{-1}$. In thermal analysis (TG), a reduction in mass of about 7% was observed at 390 to 410° C. Therefore, the charge generating material (CG-1) is estimated to be a mixture of a 1:1 adduct of titanyl phthalocyanine and (2R,3R)-2,3-butanediol and a non-adduct (not added) titanyl phthalocyanine. The BET specific surface area of the obtained charge generating material (CG-1) was measured with a fluid type specific surface area automatic measuring device (micrometrics/flow sorb type: manufactured by Shimadzu Corporation), and was 31.2 $m^2/g$.

(Formation of Charge Transporting Layer)

225 parts of a charge transporting material: the above compound A, 300 parts of a binder resin: polycarbonate resin "Z300" (manufactured by Mitsubishi Gas Chemical Company, Inc.), 6 parts of an antioxidant "Irganox (registered trademark) 1010" (manufactured by BASF Japan Ltd.), 1600 parts of a solvent: tetrahydrofuran (THF), 400 parts of a solvent: toluene, and 1 part of silicone oil "KF-50" (manufactured by Shin-Etsu Chemical Co., Ltd.) were mixed and dissolved to prepare a charge transporting layer forming coating liquid [1].

This charge transporting layer forming coating liquid [1] was applied onto the charge generating layer [1] using a circular slide hopper application apparatus (circular amount regulating type application apparatus) to form a charge transporting layer [1] having a thy layer thickness of 20 μm.

At this time, the universal hardness of an organic photoreceptor was measured from a side of the charge transporting layer as an outermost surface layer, and was 180 N/mm$^2$.

[Manufacture of Organic Photoreceptor [2]]

(Formation of Protective Layer)

164 parts of the following metal oxide particles: tin oxide particles [1], 100 parts of a polymerizable compound: the above exemplified compound (M1) (in the formula, R' represents a methacryloyl group ($CH_2{=}CCH_3CO{-}$)), 17 parts of a charge transporting agent: the above exemplified compound (CTM-1), 9 parts of a polymerization initiator: the above exemplified compound (P1), 21 parts of a radical scavenger: "Sumilizer (registered trademark) GS" ($R_5$ represents a tert-pentyl group and $R_6$ represents a tert-pentyl group in the above general formula (2)) (manufactured by Sumitomo Chemical Co., Ltd.), 280 parts of a solvent: 2-butanol, and 70 parts of a solvent: tetrahydrofuran were mixed and stirred, and sufficiently dissolved and dispersed to prepare a protective layer forming coating liquid [1]. This protective layer forming coating liquid [1] was applied onto the charge transporting layer of the organic photoreceptor [1] using a circular slide hopper application apparatus to form a coating film. A distance from a light source to a surface of the coating film was set to 100 mm, and the coating film was irradiated with an ultraviolet ray at a lamp output of 4 kW for one minute under a nitrogen stream using a metal halide lamp to form a protective layer having a dry layer thickness of 4.0 μm. In this way, an organic photoreceptor [2] was obtained. At this time, the universal hardness of the organic photoreceptor was measured from a side of a protective layer as an outermost surface layer, and was 220 N/mm$^2$.

(Preparation of Tin Oxide Particles [1])

By using the following tin oxide [1] as untreated metal oxide particles and using the above exemplified compound (S-15) as a surface modifier, surface modification was performed as follows to prepare tin oxide particles [1].

First, tin oxide (number average primary particle diameter: 20 nm, volume resistivity: $1.05\times10^5$ (Ω·cm)) manufactured by CIK Nanotech Co., Ltd. was prepared as tin oxide [1].

Next, a mixture solution of 100 parts of tin oxide [1], 30 parts of a surface modifier (exemplified compound (S-15): $CH_2{=}C(CH_3)COO(CH_2)_3Si(OCH_3)_3$), and 300 parts of a mixed solvent of toluene/isopropyl alcohol=1/1 (mass ratio) was put in a sand mill together with zirconia beads, and surface modification was performed by stirring the resulting mixture at a rotation speed of 1500 rpm at about 40° C. Furthermore, the treatment mixture was taken out, put in a Henschel mixer (registered trademark), stirred at a rotation speed of 1500 rpm for 15 minutes, and then dried at 120° C. for three hours to finish the surface modification. As a result, surface-modified tin oxide particles [1] were prepared.

[Manufacture of Organic Photoreceptors [3] to [10]]

Organic photoreceptors [3] to [10] were manufactured in a similar manner to manufacture of the organic photoreceptor [2] except that the addition amounts (parts) of the polymerizable compound (M1), the polymerization initiator (P1), the radical scavenger (Sumilizer GS), the tin oxide particles [1], and the charge transporting material (CTM-1) used were changed as illustrated in the following Table 1 in formation of a protective layer in manufacture of the organic photoreceptor [2].

The universal hardness of each of the organic photoreceptors [3] to [10] was measured in a similar manner to the organic photoreceptor [2].

<Evaluation of Organic Photoreceptor>

[Universal Hardness (HU)]

The universal hardness of each of the organic photoreceptors was measured from a side of a charge transporting layer or a protective layer as an outermost surface layer on the opposite side to a side of the conductive support.

The universal hardness is defined by the following formulas (4) and (5).

[Numerical formula 6]

$$HU = \frac{F}{A(h)} = \frac{F}{26.43\times h^2} \quad \text{Formula (4)}$$

$$A(h) = \frac{4\times\sin(a/2)}{\cos^2(a/2)}\times h^2 \quad \text{Formula (5)}$$

In the above formulas (4) and (5), F represents a test load (N), A (h) represents a surface area (mm$^2$) of an indenter in contact with an object to be measured, and h represents an indentation depth (mm) when a test load acts. A (h) is calculated from the shape of an indenter and an indentation depth. In a case where the indenter is a Vickers indenter, A (h) is calculated as $26.43\times h^2$ from an angle a (136°) of a facing surface of a pyramidal intrusion body.

The universal hardness (HU) was measured under the following measurement conditions using an ultramicro hardness tester "H-100V" (manufactured by Fischer Instruments K. K.).

(Measurement Conditions)

Measuring machine: ultramicro hardness tester "H-100V" (manufactured by Fischer Instruments K. K.), Indenter shape: Vickers indenter (a=136°), Measurement environment: 20° C., 60% RH, Maximum test load: 3 mN, Load speed: 3 mN/20 sec, Maximum load creep time: 5 seconds, and Unloading speed: 3 mN/20 sec.

Note that measurement was performed for each sample at a total of 15 points of 5 points at equally spaced intervals in an axial direction and 3 points at uniform angles in a circumferential direction, and an average value thereof was taken as a universal hardness.

Presence or absence of a protective layer, a protective layer forming material, and a measurement result of a universal hardness in each organic photoreceptor are illustrated in the following Tables 1 and 2. Note that the volume ratio of each component in Table 2 was calculated by assuming that the total volume ratio of components excluding a solvent was 100, and calculated using a mass ratio by assuming that the specific gravity of tin oxide was 6.95 and the specific gravity of an organic material as another component was 1.1.

TABLE 1

Mass ratio of each component for protective layer forming material of organic photoreceptor and universal hardness of organic photoreceptor

| Organic photo-receptor | Protective layer: Presence or absence | Composition: Polymer-izable compound [M1] | Tin oxide [1] | Charge transporting agent [CTM-1] | Radical scavenger [GS] | Polymer-ization initiator [P1] | Universal hardness measured from outermost surface layer ($N/mm^2$) |
|---|---|---|---|---|---|---|---|
| [1] | Absence | | | | | | 180 |
| [2] | Presence | 100 | 164 | 17 | 21 | 9 | 220 |
| [3] | Presence | 100 | 159 | 17 | 17 | 8 | 230 |
| [4] | Presence | 100 | 154 | 16 | 13 | 8 | 240 |
| [5] | Presence | 100 | 148 | 16 | 9 | 8 | 250 |
| [6] | Presence | 100 | 144 | 15 | 6 | 8 | 260 |
| [7] | Presence | 100 | 140 | 15 | 3 | 7 | 270 |
| [8] | Presence | 100 | 136 | 15 | 0 | 7 | 280 |
| [9] | Presence | 100 | 127 | 7 | 0 | 7 | 300 |
| [10] | Presence | 100 | 118 | 0 | 0 | 6 | 320 |

In Table, [GS] indicates Sumilizer (registered trademark) GS (manufactured by Sumitomo Chemical Co., Ltd.).

TABLE 2

Volume ratio of each component relative to total volume (100) of protective layer forming material of organic photoreceptor and universal hardness of organic photoreceptor

| Organic photo-receptor | Protective layer: Presence or absence | Composition: Polymer-izable compound [M1] | Tin oxide [1] | Charge transporting agent [CTM-1] | Radical scavenger [GS] | Polymer-ization initiator [P1] | Universal hardness measured from outermost surface layer ($N/mm^2$) |
|---|---|---|---|---|---|---|---|
| [1] | Absence | | | | | | 180 |
| [2] | Presence | 58 | 15 | 10 | 12 | 5 | 220 |
| [3] | Presence | 60 | 15 | 10 | 10 | 5 | 230 |
| [4] | Presence | 62 | 15 | 10 | 8 | 5 | 240 |
| [5] | Presence | 64 | 15 | 10 | 6 | 5 | 250 |
| [6] | Presence | 66 | 15 | 10 | 4 | 5 | 260 |
| [7] | Presence | 68 | 15 | 10 | 2 | 5 | 270 |
| [8] | Presence | 70 | 15 | 10 | 0 | 5 | 280 |
| [9] | Presence | 75 | 15 | 5 | 0 | 5 | 300 |
| [10] | Presence | 80 | 15 | 0 | 0 | 5 | 320 |

In Table, [GS] indicates Sumilizer (registered trademark) GS (manufactured by Sumitomo Chemical Co., Ltd.).

<Manufacture of Developing Agent>

[Preparation of Colorant Dispersion]

(Preparation of Colorant Dispersion [K])

90 g of sodium dodecyl sulfate was stirred and dissolved in 1600 ml of deionized water. While this solution was stirred, 420 g of carbon black (Regal 330R: manufactured by Cabot Corporation) was gradually added thereto, and then the resulting solution was dispersed using a stirring device "CLEARMIX" (manufactured by M Technique Co., Ltd.) to prepare a dispersion of colorant particles. This is referred to as "colorant dispersion [K]". The particle diameter of each of the colorant particles in this colorant dispersion [K] was measured using an electrophoretic light scattering photometer "ELS-800" (manufactured by Otsuka Electronics Co., Ltd.), and was 110 nm.

(Preparation of Colorant Dispersion [C])

A colorant dispersion [C] in which colorant particles having a particle diameter of 112 nm in terms of a volume-based median diameter were dispersed was prepared in a similar manner to the preparation example of the colorant dispersion [K] except that C.I. Pigment Blue 15:3 was used in place of carbon black as a colorant.

(Preparation of Colorant Dispersion [M])

A colorant dispersion [M] in which colorant particles having a particle diameter of 115 nm in terms of a volume-based median diameter were dispersed was prepared in a similar manner to the preparation example of the colorant dispersion [K] except that C.I. Pigment Red 122 was used in place of carbon black as a colorant.

(Preparation of Colorant Dispersion [Y])

A colorant dispersion [Y] in which colorant particles having a particle diameter of 118 nm in terms of a volume-based median diameter were dispersed was prepared in a similar manner to the preparation example of the colorant dispersion [K] except that C.I. Pigment Yellow 74 was used in place of carbon black as a colorant.

[Preparation of Toner Base Particles]

(Preparation of Toner Base Particles [1])

(Preparation of Resin Particles A)

First Stage Polymerization

In a 5 L reaction container equipped with a stirrer, a temperature sensor, a cooling tube, and a nitrogen introducing device, 8 g of sodium dodecylsulfate and 3 L of deionized water were put. While the resulting mixture was stirred at a stirring speed of 230 rpm under a nitrogen stream, the internal temperature was raised to 80° C. After the temperature was raised, a solution obtained by dissolving 10 g of potassium persulfate in 200 g of deionized water was added, and the temperature of the solution was again set to 80° C. The following monomer mixture solution was added dropwise over one hour. Thereafter, the resulting mixture was heated and stirred at 80° C. for two hours to perform polymerization, thereby preparing resin particles. The resin particles are referred to as "resin particles (1H)".

Styrene 480 g
n-Butyl acrylate 250 g
Methacrylic acid 68.0 g
n-Octanethiol 16.0 g Second Stage Polymerization In a 5 L reaction container equipped with a stirrer, a temperature sensor, a cooling tube, and a nitrogen introducing device, a solution obtained by dissolving 7 g of sodium polyoxyethylene (2) dodecyl ether sulfate in 800 ml of deionized water was put. The solution was heated to 98° C. Thereafter, 260 g of the resin particles (1H) and a solution obtained by dissolving the following monomer solution at 90° C. were added, and the resulting mixture was mixed and dispersed using a mechanical dispersing machine CLEARMIX (M Technique Co., Ltd.) having a circulation path for one hour to prepare a dispersion containing emulsified particles (oil droplets).

Styrene 223 g
n-Butyl acrylate 142 g
n-Octanethiol 1.5 g
Polyethylene wax (melting point 70° C.) 190 g Subsequently, an initiator solution obtained by dissolving 6 g of potassium persulfate in 200 ml of deionized water was added to this dispersion. This system was heated and stirred at 82° C. for one hour to perform polymerization, thereby preparing resin particles. The resin particles are referred to as "resin particles (1HM)".

Third Stage Polymerization

A solution obtained by dissolving 11 g of potassium persulfate in 400 ml of deionized water was further added. At a temperature condition of 82° C., a monomer mixture solution containing:
405 g of styrene;
162 g of n-butyl acrylate;
33 g of methacrylic acid; and
8 g of n-octanethiol was added dropwise over one hour. After completion of the dropwise addition, the resulting mixture was heated and stirred for two hours to perform polymerization, and then cooled 28° C. to prepare a dispersion of resin particles. This is referred to as a dispersion of "resin particles A". A part of the dispersion of the resin particles A was collected, washed, and dried. Thereafter, Tg of the resin particles A was measured, and was 21° C.

(Preparation of Resin Particles B)

In a 5 L reaction container equipped with a stirrer, a temperature sensor, a cooling tube, and a nitrogen introducing device, 2.3 g of sodium dodecylsulfate and 3 L of deionized water were put. While the resulting mixture was stirred at a stirring speed of 230 rpm under a nitrogen stream, the internal temperature was raised to 80° C. After the temperature was raised, a solution obtained by dissolving 10 g of potassium persulfate in 200 g of deionized water was added, and the temperature of the solution was again set to 80° C. The following monomer mixture solution was added dropwise over one hour. Thereafter, the resulting mixture was heated and stirred at 80° C. for two hours to perform polymerization, thereby preparing resin particles, and a dispersion of the resin particles was prepared. This is referred to as a dispersion of "resin particles B".

Styrene 520 g
n-Butyl acrylate 210 g
Methacrylic acid 68.0 g
n-Octanethiol 16.0 g A part of the dispersion of the resin particles B was collected, washed, and dried. Thereafter, Tg of the resin particles B was measured, and was 48° C.

(Aggregation/Fusion Step)

In a 5 L reaction container equipped with a stirrer, a temperature sensor, a cooling tube, and a nitrogen introducing device, a solution obtained by dissolving 300 g of the resin particles A in terms of solid content, 1400 g of deionized water, 120 g of "colorant dispersion [K]", and 3 g of sodium polyoxyethylene (2) dodecyl ether sulfate in 120 ml of deionized water was put. The temperature of the solution was adjusted to 30° C. Thereafter, a 5 N sodium hydroxide aqueous solution was added to adjust the pH to 10. Subsequently, an aqueous solution obtained by dissolving 35 g of magnesium chloride in 35 ml of deionized water was added under stirring at 30° C. over 10 minutes. The temperature was maintained for three minutes, and then the temperature was started to be raised. This system was heated to 90° C. over 60 minutes. While the temperature was maintained at 90° C., a particle growth reaction was continued. In this state, the particle diameter of an associated particles was measured using "Coulter Multisizer 3". When the particle diameter reached 3.1 μm in terms of a volume-based median diameter, 260 g of the dispersion of the resin particles B was added, and a particle growth reaction was further continued. When the particle diameter reached a desired particle diameter, an aqueous solution obtained by dissolving 150 g of sodium chloride in 600 ml of deionized water was added to stop particle growth. The resulting solution was further heated and stirred at a solution temperature of 98° C. as a fusion step. Fusing between the particles was thereby allowed to proceed until circularity reached 0.965 as measured by FPIA-2100. Thereafter, the temperature of the solution was lowered to 30° C. Hydrochloric acid was added to adjust the pH to 4.0, and stirring was stopped.

(Washing/Drying Step)

The particles generated in the aggregation/fusion step were solid-liquid separated using a basket type centrifuge "MARK III model number 60×40" (manufactured by Matsumoto Machine Sales Co., Ltd.) to form a wet cake of toner base particles. The wet cake was washed with deionized water at 45° C. until the electric conductivity of a filtrate reached 5 μS/cm using the basket type centrifuge, then transferred to a "flash jet dryer" (manufactured by Seishin Enterprise Co., Ltd.), and dried until the water content reached 0.5% by mass to prepare toner base particles [1].

(Preparation of Toner Base Particles [2])

Toner base particles [2] were prepared in a similar manner to the step of preparing the toner base particles [1] except that the colorant dispersion was changed to the colorant dispersion [C].

(Preparation of Toner Base Particles [3])

Toner base particles [3] were prepared in a similar manner to the step of preparing the toner base particles [1] except that the colorant dispersion was changed to the colorant dispersion [M].

(Preparation of Toner Base Particles [4])

Toner base particles [4] were prepared in a similar manner to the step of preparing the toner base particles [1] except that the colorant dispersion was changed to the colorant dispersion [Y].

[Preparation of Toner]

(Preparation of Toner [1])

To 100 parts by mass of the toner base particles [1], 0.6 parts by mass of silica particle NAX-50 (manufactured by Nippon Aerosil Co., Ltd.), 0.6 parts by mass of silica particle R805 (manufactured by Nippon Aerosil Co., Ltd.), 0.2 parts by mass of titania particles STT30S (manufactured by Titan Kogyo Ltd.), and 0.05 parts by mass of zinc stearate particles (product name: zinc stearate S, manufactured by NOF CORPORATION, volume-based median diameter Dw: 15 μm) as a fine powder lubricant were added. The resulting mixture was mixed using a Henschel mixer (registered trademark) "FM10B" (manufactured by Mitsui Miike Chemical Engineering Machinery, Co., Ltd.) at a stirring blade circumferential speed of 40 m/second and a treatment temperature of 30° C. for 12 minutes. Thereafter, coarse particles were removed using a sieve with an opening of 90 μm to prepare a toner [1].

Here, the volume-based median diameter Dw of the fine powder lubricant was evaluated by performing measurement and calculation using a device connecting a data processing computer system (manufactured by Beckman Coulter, Inc.) to a Coulter Multisizer 3 (manufactured by Beckman Coulter, Inc.). As a measuring procedure, 0.02 g of the fine powder lubricant was blended with 20 ml of a surfactant solution (surfactant solution obtained by diluting a neutral detergent containing a surfactant component 10 times with pure water). Thereafter, the resulting mixture was ultrasonically dispersed for one minute to prepare a lubricant dispersion. This lubricant dispersion was poured into a beaker containing ISOTON II (manufactured by Beckman Coulter, Inc.) in a sample stand with a pipette until a concentration indicated on a measuring machine reached 5% to 10%. By setting the count number of measurement particles to 25000, setting an aperture diameter to 50 μm, and dividing a range of 1 to 30 μm as a measurement range into 256 parts in the measuring machine, a frequency value was calculated. Then, a particle diameter of 50% from a side having a larger volume cumulative fraction was taken as a volume-based median diameter.

(Preparation of Toners [2] to [4])

Toners [2] to [4] were prepared in a similar manner to the step of preparing the toner [1] except that the toner base particles [1] were changed to the toner base particles [2] to [4], respectively.

[Manufacture of Developing Agent]

(Manufacture of Two-Component Developing Agent [1])

A ferrite carrier coated with a copolymer of cyclohexyl methacrylate and methyl methacrylate (monomer ratio 1:1) and having a volume-based median diameter of 33 μm was mixed with the toner [1] such that a toner concentration reached 6.0% by mass to manufacture a two-component developing agent [1].

(Manufacture of Two-Component Developing Agents [2] to [4])

Two-component developing agents [2] to [4] were manufactured in a similar manner to the preparation of the two-component developing agent [1] except that the toner [1] was changed to the toners [2] to [4], respectively.

<Manufacture of Electrophotographic Image Forming Device>

For an electrophotographic image forming device, a bizhub C360 (bizuhub is a registered trademark of Konica Minolta Co., Ltd.) manufactured by Konica Minolta Co., Ltd. was used. The bizhub C360 is an intermediate transfer tandem type color multi-function peripheral (MFP) that performs laser exposure with a wavelength of 780 nm and reversal development.

More specifically, the bizhub C360 includes four adjacent image forming units including toners having different colors. Each of the image forming units includes: a charger that charges a surface of an organic photoreceptor; an exposurer (electrostatic latent image former) that exposes the organic photoreceptor charged by the charger to form an electrostatic latent image; a developer that supplies a toner to the organic photoreceptor and develops the electrostatic latent image to form a toner image; a transferer that transfers a toner image formed on the organic photoreceptor; a lubricant supplier that supplies a lubricant to a surface of the organic photoreceptor; and a cleaner that removes a toner remaining on the surface of the organic photoreceptor with a cleaning blade.

Here, the developing agents [1] to [4] manufactured above were loaded in the four adjacent image forming units, respectively. The organic photoreceptors [1] to [10] prepared above were mounted as the organic photoreceptors of the above four image forming units in such a combination as illustrated in the following Table 3, and electrophotographic image forming devices in Examples and Comparative Examples were manufactured.

Here, the lubricant supplier is a means (toner supplier) that supplies a fine powder lubricant externally added to a toner to an organic photoreceptor by an action of a developing electric field formed by the developer.

<Evaluation of Electrophotographic Image Forming Device>

In an atmosphere of 20° C. and relative humidity of 50% RH, an A4-size image having a print area ratio of 5% for each color of YMCK was printed out on 300,000 A4-size neutral sheets. Thereafter, image evaluation of each photoreceptor (slipping and image flow) was performed as follows.

(Evaluation of Slipping)

Figure 4A:
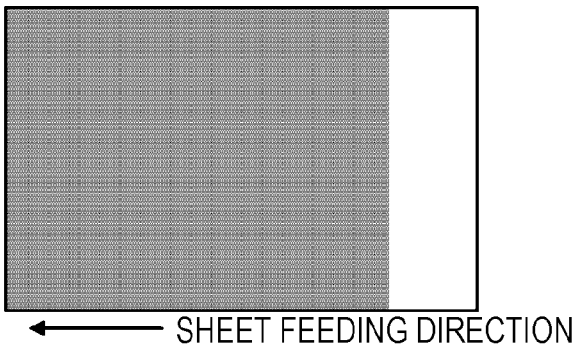
FIGS. 4A to 4C are explanatory diagrams for explaining a method for evaluating an electrophotographic image forming device.

Under an environment of 10° C. and 15% RH, a halftone image (a) (refer to FIG. 4A) having a coverage ratio of 80% was printed on 20,000 A3-size neutral sheets such that a black background portion and a white background portion were located at a front portion and at a rear portion in a sheet feeding direction, respectively. The white background portion of the 20,000th sheet was visually observed, and slipping of a toner was evaluated based on the following criteria. An evaluation result of "⊙" or "○" was judged to be acceptable.

(Evaluation Criteria)

⊙: No stain is observed in a white background portion.

○: Although a slight streaky stain is generated in a white background portion, there is no practical problem.

x: An obvious streaky stain is generated in a white background portion, and there is a practical problem.

(Evaluation of Image Flow)

Figure 4B:
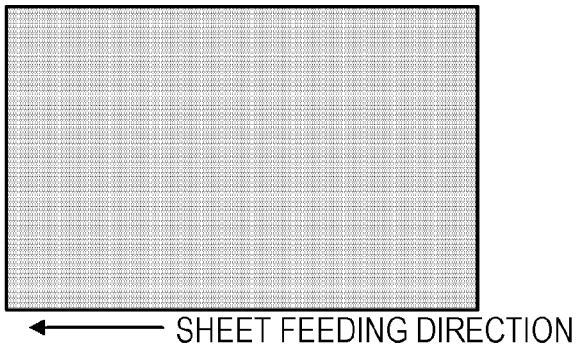
Figure 4C:
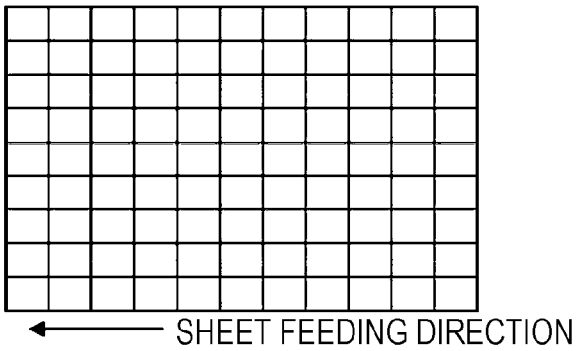

Under an environment of 30° C. and 80% RH, an A4-size character image with an image ratio of 6% was printed on 10,000 A4-size neutral sheets by transverse feeding. Immediately after printing, a main power supply of an image forming device was turned off. 12 hours after the main power supply was turned off, the main power supply was turned on. Subsequently, immediately after a printable state was achieved, a halftone image (b) (refer to FIG. 4B) (relative reflection density of 0.4 with a Macbeth densitometer) and a 6 dot lattice image (c) (refer to FIG. 4C) were printed on the entire surface of an A3-size neutral sheet. The printed halftone image and the lattice image were visually observed, and presence or absence of occurrence of an image flow was evaluated for each photoreceptor based on the following criteria. An evaluation result of "⊙" or "○" was judged to be acceptable.

(Evaluation Criteria)

⊙: There is no density unevenness in a halftone image, and there is no defect or thinning of a line width in a lattice image.

○: A band-shaped density lowering region is observed in a long axis direction of a photoreceptor in a halftone image, but there is no defect or thinning of a line width in a lattice image.

x: A defect or thinning of a line width is observed in a lattice image.

indicates a value of Hb−Ha when a difference obtained by subtracting the universal hardness Ha of the organic photoreceptor A included in an image forming unit disposed on an upstream side from the universal hardness Hb of the organic photoreceptor B included in an image forming unit disposed on a downstream side is 10 N/mm$^2$ or more in a combination composed of two adjacent image forming units including toners having different colors. In addition, "A (K−Y)" indicates a difference obtained by subtracting the universal hardness Hmu of the organic photoreceptor MU (organic photoreceptor of Y in the present device) included in an image forming unit disposed at the most upstream from the universal hardness Hmd of the organic photoreceptor MD (organic photoreceptor of K in the present device) included in an image forming unit disposed at the most downstream.

TABLE 3

Disposition of organic photoreceptor in electrophotographic image forming device

| | Upstream side ← Disposition of image forming unit → Downstream side | | | | | | | | | |
|---|---|---|---|---|---|---|---|---|---|---|
| | Y Developing agent [4] | | M Developing agent [3] | | C Developing agent [2] | | K Developing agent [1] | | | |
| | Organic photo-receptor | Universal hardness measured from outermost surface layer (N/mm$^2$) | Organic photo-receptor | Universal hardness measured from outermost surface layer (N/mm$^2$) | Organic photo-receptor | Universal hardness measured from outermost surface layer (N/mm$^2$) | Organic photo-receptor | Universal hardness measured from outermost surface layer (N/mm$^2$) | Difference of Hb − Ha in a case of Hb − Ha ≥ 10 (N/mm$^2$) | Δ (K − Y) (N/mm$^2$) |
| Example 1 | [3] | 230 | [4] | 240 | [5] | 250 | [6] | 260 | 10 | 30 |
| Example 2 | [3] | 230 | [3] | 230 | [5] | 250 | [5] | 250 | 20 | 20 |
| Example 3 | [2] | 220 | [5] | 250 | [5] | 250 | [8] | 280 | 30 | 60 |
| Example 4 | [1] | 180 | [5] | 250 | [6] | 260 | [9] | 300 | 70, 10, 40 | 120 |
| Example 5 | [1] | 180 | [5] | 250 | [5] | 250 | [10] | 320 | 70 | 140 |
| Example 6 | [4] | 240 | [4] | 240 | [4] | 240 | [5] | 250 | 10 | 10 |
| Comparative Example 1 | [4] | 240 | [4] | 240 | [4] | 240 | [4] | 240 | | 0 |
| Comparative Example 2 | [7] | 270 | [7] | 270 | [7] | 270 | [7] | 270 | | 0 |

TABLE 4

Evaluation result of electrophotographic image forming device

| | Evaluation result of slipping Upstream side ← Disposition of image forming unit → Downstream side | | | | Evaluation result of image flow Upstream side ← Disposition of image forming unit → Downstream side | | | |
|---|---|---|---|---|---|---|---|---|
| | Y | M | C | K | Y | M | C | K |
| Example 1 | ⊙ | ⊙ | ⊙ | ⊙ | ⊙ | ⊙ | ⊙ | ⊙ |
| Example 2 | ⊙ | ○ | ⊙ | ○ | ⊙ | ⊙ | ⊙ | ⊙ |
| Example 3 | ⊙ | ⊙ | ⊙ | ⊙ | ⊙ | ⊙ | ⊙ | ⊙ |
| Example 4 | ○ | ⊙ | ⊙ | ⊙ | ⊙ | ⊙ | ⊙ | ⊙ |
| Example 5 | ○ | ⊙ | ⊙ | ⊙ | ⊙ | ⊙ | ⊙ | ○ |
| Example 6 | ⊙ | ⊙ | ⊙ | ○ | ○ | ⊙ | ⊙ | ⊙ |
| Comparative Example 1 | ⊙ | ⊙ | ○ | X | ○ | ⊙ | ⊙ | ⊙ |
| Comparative Example 2 | ⊙ | ⊙ | ⊙ | ⊙ | X | ○ | ○ | ⊙ |

Evaluation results of an electrophotographic image forming device are illustrated in the following Tables 3 and 4. Incidentally, in the following Tables 3 and 4, Y, M, C, and K indicate that toner colors of image forming units correspond to a yellow (Y) color, a magenta (M) color, a cyan (C) color, and a black (K) color, respectively. In the following Table 3, "difference of Hb−Ha in a case of Hb−Ha≥10"

From the results of Tables 3 and 4, it has been confirmed that the tandem type electrophotographic image forming device according to the embodiment of the present invention suppresses an image flow of a formed image, suppresses slipping of a toner, and realizes prolongation of the lifetime of an organic photoreceptor, eventually prolongation of the lifetime of the device itself.

Although embodiments of the present invention have been described and illustrated in detail, the disclosed embodiments are made for purposes of illustration and example only and not limitation. The scope of the present invention should be interpreted by terms of the appended claims

What is claimed is:

1. A tandem type electrophotographic image forming device using an organic photoreceptor obtained by sequentially laminating at least a charge generating layer and a charge transporting layer on a conductive support, the electrophotographic image forming device comprising:

a plurality of image forming units each including at least: an electrostatic latent image former that forms an electrostatic latent image on the organic photoreceptor; a developer that supplies a toner to the organic photoreceptor and develops the electrostatic latent image to form a toner image; a lubricant supplier that supplies a lubricant to a surface of the organic photoreceptor; and a cleaner that removes a toner remaining on the surface of the organic photoreceptor with a cleaning blade, wherein at least one combination composed of the two adjacent image forming units including toners having different colors satisfies the following formula (1) where Ha is a universal hardness of an organic photoreceptor A included in the image forming unit disposed on an upstream side, and Hb is a universal hardness of an organic photoreceptor B included in the image forming unit disposed on a downstream side:

$$Hb-Ha \geq 10\ \mathrm{N/mm^2} \quad (1),$$

among the combinations each composed of the two adjacent image forming units including toners having different colors, all combinations that do not satisfy the above formula (1) satisfy the following formula (2):

$$Hb \geq Ha \quad (2),$$

a universal hardness of an organic photoreceptor MU included in the image forming unit disposed at a most upstream and a universal hardness of an organic photoreceptor MD included in the image forming unit disposed at a most downstream satisfy the following formula (3) where Hmu is the universal hardness of the organic photoreceptor MU and Hmd is the universal hardness of the organic photoreceptor MD:

$$Hmd-Hmu \geq 10\ \mathrm{N/mm^2} \quad (3), \text{ and}$$

whereby satisfaction of formulas (1), (2) and (3) inhibits image flow of a formed image, inhibits toner slippage and prolongs organic photoreceptor life.

2. The electrophotographic image forming device according to claim 1, wherein the number of the image forming units is three or more, and at least two combinations each composed of the two adjacent image forming units including toners having different colors satisfy the above formula (1).

3. The electrophotographic image forming device according to claim 1, wherein all combinations each composed of the two adjacent image forming units including toners having different colors satisfy the above formula (1).

4. The electrophotographic image forming device according to claim 1, wherein at least one of the organic photoreceptors B is for black.

5. The electrophotographic image forming device according to claim 1, wherein at least one of the organic photoreceptors A is for a chromatic color.

6. The electrophotographic image forming device according to claim 1, wherein at least one of the organic photoreceptors further has a protective layer on an outermost surface, and a universal hardness measured from a side of the protective layer is 220 $N/mm^2$ or more and 320 $N/mm^2$ or less.

7. The electrophotographic image forming device according to claim 6, wherein the protective layer contains a cured resin component which is a cured product of a polymerizable compound.

8. The electrophotographic image forming device according to claim 6, wherein the protective layer contains metal oxide particles.

9. The electrophotographic image forming device according to claim 6, wherein the protective layer contains a charge transporting agent having a structure represented by the following general formula (1):

General formula (1)

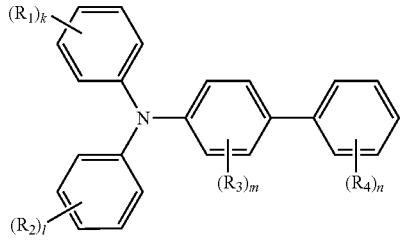

where in general formula (1), $R_1$, $R_2$, $R_3$, and $R_4$ each independently represent an alkyl group having 1 to 7 carbon atoms or an alkoxy group having 1 to 7 carbon atoms, k, l, and n each independently represent an integer of 0 to 5, and m represents an integer of 0 to 4, and where in a case where k, l, n, or m is 2 or more, a plurality of $R_1$s may be the same as or different from one another, a plurality of $R_2$s may be the same as or different from one another, a plurality of $R_3$s may be the same as or different from one another, and a plurality of $R_4$s may be the same as or different from one another.

10. The electrophotographic image forming device according to claim 6, wherein the protective layer contains a radical scavenger having a structure represented by the following general formula (2):

General formula (2)

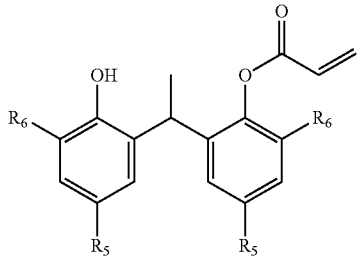

where in the above general formula (2), $R_5$ and $R_6$ each independently represent an alkyl group having 1 to 6 carbon atoms.

11. The electrophotographic image forming device according to claim 1, wherein the lubricant contains a fatty acid metal salt.

12. The electrophotographic image forming device according to claim 1, wherein the lubricant supplier supplies the fine powder lubricant contained in the toner to the organic photoreceptor by an action of a developing electric field formed by the developer.

* * * * *